US007287843B2

(12) United States Patent
Muranaka et al.

(10) Patent No.: US 7,287,843 B2
(45) Date of Patent: Oct. 30, 2007

(54) INK BAG, INK CARTRIDGE AND INK-JET RECORDING APPARATUS, INK FILLING METHOD, INK REFILLING METHOD, MANUFACTURING METHOD OF INK CARTRIDGE, AND RECYCLING METHOD OF INK CARTRIDGE

(75) Inventors: Masakazu Muranaka, Tokyo (JP); Masato Suzuki, Shizuoka (JP); Takanori Tsuyuki, Shizuoka (JP); Masami Iguchi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 274 days.

(21) Appl. No.: 10/514,415

(22) PCT Filed: Mar. 15, 2004

(86) PCT No.: PCT/JP2004/003431

§ 371 (c)(1),
(2), (4) Date: Nov. 15, 2004

(87) PCT Pub. No.: WO2004/082944

PCT Pub. Date: Sep. 30, 2004

(65) Prior Publication Data

US 2005/0157109 A1 Jul. 21, 2005

(30) Foreign Application Priority Data

Mar. 18, 2003 (JP) ..... 2003-074520
Mar. 20, 2003 (JP) ..... 2003-076663
Mar. 20, 2003 (JP) ..... 2003-076676
Jun. 26, 2003 (JP) ..... 2003-183326

(51) Int. Cl.
*B41J 2/175* (2006.01)

(52) U.S. Cl. ..... 347/86

(58) Field of Classification Search ..... 347/85, 347/86, 87
See application file for complete search history.

(56) References Cited

U.S. PATENT DOCUMENTS 5,307,091 A * 4/1994 DeCoste, Jr. ..... 347/86
5,400,066 A * 3/1995 Matsumoto et al. ..... 347/86
5,721,576 A * 2/1998 Barinaga ..... 347/85
5,896,151 A * 4/1999 Miyazawa et al. ..... 347/86
6,106,112 A * 8/2000 Okubo et al. ..... 347/86

(Continued)

FOREIGN PATENT DOCUMENTS

CN 1193570 A 9/1998

(Continued)

OTHER PUBLICATIONS

Chinese official action dated Nov. 3, 2006 and English translation thereof.

*Primary Examiner*—Ahn T. N. Vo
(74) *Attorney, Agent, or Firm*—Cooper & Dunham, LLP

(57) ABSTRACT

An ink bag comprises a flexible bag body of a generally rectangular form and a holding member attached to one edge of the bag body, wherein the holding member includes: an ink filling opening for filling the bag body with ink; an ink discharging opening for discharging the ink inside the bag body; and an engaging part for holding the ink bag to a cartridge case in which the ink bag is accommodated.

33 Claims, 26 Drawing Sheets

U.S. PATENT DOCUMENTS

| | | | | |
|---|---|---|---|---|
| 6,264,314 | B1 * | 7/2001 | Mochizuki et al. | 347/86 |
| 6,267,474 | B1 * | 7/2001 | Mochizuki | 347/68 |
| 6,609,789 | B1 * | 8/2003 | Hunt | 347/86 |
| 6,705,714 | B1 * | 3/2004 | Petranek | 347/86 |
| 7,137,689 | B2 * | 11/2006 | Sasaki et al. | 347/86 |

FOREIGN PATENT DOCUMENTS

| | | | | |
|---|---|---|---|---|
| EP | 0857573 | A2 | 8/1998 | |
| JP | 63-2788 | | 1/1988 | |
| JP | 401180351 | A * | 7/1989 | 347/86 |
| JP | 5-162333 | | 6/1993 | |
| JP | 7-323559 | | 12/1995 | |
| JP | 10-202900 | | 8/1998 | |
| JP | 10-202901 | | 8/1998 | |
| JP | 2001-150691 | | 6/2001 | |
| JP | 2002-248784 | | 9/2002 | |
| JP | 2003-54002 | | 2/2003 | |

* cited by examiner

INK BAG, INK CARTRIDGE AND INK-JET RECORDING APPARATUS, INK FILLING METHOD, INK REFILLING METHOD, MANUFACTURING METHOD OF INK CARTRIDGE, AND RECYCLING METHOD OF INK CARTRIDGE

TECHNICAL FIELD

The present invention relates to ink bag, ink cartridge structure and ink-jet recording apparatus, ink filling method, ink refilling method, manufacturing method of ink cartridge and recycling method of ink cartridge.

BACKGROUND ART

An ink-jet recording apparatus is used extensively for image formation apparatuses (called also as image recording apparatus) such as printers, facsimiles, copiers, and the like.

An ink-jet recording apparatus carries out recording of images on a sheet by discharging ink from a recording head. Here, sheet is not limited to paper but also includes OHP sheet, and the like. Thus, "sheet" represents the medium on which images are formed and is also called as medium to be recorded or recording medium, or recording paper. An ink-jet recording apparatus has various advantageous features such as capability of recording high-definition images at high speed, low running cost, little noise, and capability of recording color images easily by using multiple color inks.

For the ink cartridge used in conventional ink-jet recording apparatuses, there is disclosed a device in Japanese Laid-Open Patent Application 10-202901, in which ink is filled in a hard case of rectangular shell, or there exists a device described in Japanese Laid-Open Patent Application 10-202900 having a flexible bag-like tank equipped with an ink exit and a chassis (case) provided with an opening so as to allow loading and unloading of the ink tank to and from the chassis through the opening.

Further, as shown in FIG. 1, there is a known ink cartridge formed of an ink storage part 501 for storing ink, a cylindrical case 502 accommodating therein the ink storage part 501, and a cover lid member 503 covering the front face of the cylindrical case 502. In this construction, there is further provided a holding member 504 integral to the ink storage part 501 such that the holding member 504 includes a sealed ink filling opening 505 of cylindrical form used for filling the ink and an ink supplying opening 506 of cylindrical form for supplying the ink. In operation, the holding member 504 is fixed upon the cylindrical case 502 by pushing the holding member 504 in such a manner that a protrusion part 504*a* of the holding member 504 catches a hole 502*a* provided on the wall midway of the cylindrical case 502.

Here, the ink storage part 501 forms a frame body 511 together with the holding member 504 and a film-like member 512 formed of an inner resin film and an outer aluminum film is welded upon the frame body 511 at the outside thereof.

Meanwhile, in recent ink-jet recording apparatuses, the required picture quality is increasing, and associated with this, the ink consumption is increasing also. Under such a situation, there arises a problem, in a conventional ink-jet recording apparatus in which the ink cartridge is mounted on a carriage, in that frequent exchange ink cartridge becomes necessary. Thus, there is a tendency in the art of ink-jet recording to employ a construction in which only a small sub tank is mounted on the carriage and the ink is supplied to the sub tank from a main ink cartridge, which is mounted on the body of the ink-jet recording apparatus.

Thus, the size of the ink cartridge is increasing, while such an increase of the size of the ink cartridge raises the problem in that mere discarding of used ink cartridge as in the case of the ink cartridge described in the Japanese Laid Open Patent Application 10-202901 causes the problem of serious waste of resources. Thus, it has become necessary to provide a construction that enables effective reuse of the resources.

In view of the situation noted above, there is proposed an ink cartridge in the Japanese Laid Open Patent Application 10-202900 that allows detachable accommodation of the ink tank in the chassis part, while such a conventional construction has a drawback in that the ink tank is unstable and stable supply of the ink is difficult.

In the case the ink cartridge is plugged into the main body of the ink-jet recording apparatus from an upward direction with such an orientation such that the ink supplying opening (supply opening) faces the downward direction, the ink tank is held in the chassis part in a somewhat stabilized state. On the other hand, in the case of using the construction in which the ink cartridge is plugged into the main body from the front side with such an orientation that the ink supplying opening faces a lateral or horizontal direction (hereinafter, such a construction will be called "front loading construction"), the ink tank is held in the chassis in the inclined state. Thus, such a front loading structure cannot be used.

Furthermore, with the ink cartridge shown in FIG. 1, there arises a problem poor operability when assembling or deassembling the cartridge in view of the fact that it becomes necessary to push the holding member formed integral with the frame body of the ink storage part into the cylindrical case having an opening generally the same size of the holding member and then to pull out the holding member from the cylindrical case.

Also, there exists a problem of poor stability when supplying ink by removing the ink storage part from the cylindrical case together with the holding member. Further, in the case the ink is supplied in the state in which the ink storage part is mounted to the cylindrical case together with the holding member, there arises a problem in that it is not possible to confirm the status of the ink storage part. Thus, there is a problem in such a construction that refilling of the ink is difficult.

Further, because of the construction of the ink storage part of FIG. 1 in which the film-like member 512 is attached to the frame body 511 forming a unitary body with the holding member 504, there arise problems such as a gap being formed easily between the frame body 511 and the film-like member 512, and it is difficult to apply external pressure to the film-like member 512, leading to the problem that unused ink tends to remain in the ink storage part.

In view of the problems noted above, it is preferable to construct the ink storage part in the form of a bag such that the entire ink storage part has flexibility.

On the other hand, in the case the ink storage part is constructed in the form of flexible bag, it becomes necessary to provide a protection cover for improving load/unload operability to and from the recording apparatus main body and further for improving durability, while such a necessity raises the problem of providing a construction enabling easy loading and unloading of the flexible ink bag having a protective cover at the time of refilling of the ink.

DISCLOSURE OF THE INVENTION

The present invention is made in view of the problems noted above and has its object of providing an ink bag wherein waste of unused ink is minimized and can be easily mounted to a protective cover detachably and with stability. Further, the present invention provides an ink cartridge accommodating such an ink bag, an ink-jet recording apparatus using such an ink cartridge, an ink filling method for filling the ink bag with ink easily, an ink refilling method for filling the ink bag with ink easily, a recycling method enabling recycling of the ink cartridge, and a manufacturing method of such an ink cartridge.

In order to solve the foregoing problems and achieve the object, the present invention provides an ink bag comprising a flexible bag main body of generally quadrilateral form and a holding member attached to one edge of said ink bag main body, said holding member having an ink filling opening for filling ink to said bag main body and an ink discharge port for discharging the ink inside said bag main body, said ink bag further comprising an engagement part for holding said ink bag to a cartridge case in which said ink bag is accommodated.

Here, it is desirable that said bag has a width (W)-to-height (H) ratio (W/H) falling in the range of $1 \leqq W/H \leqq 1.5$ or $1.5 \leqq 1$. Also, the ink filling opening and the ink discharge port of the holding member are preferably located generally at the central part of the edge of the bag main body. Further, it is preferable that the holding member of the ink bag is held, when accommodated in the cartridge case, in such a state that the ink discharge port is located generally at the center of the cartridge case in a height direction.

Also, it is preferable that the ink filling opening is sealed by way of welding in the state in which ink is filled in the bag main body. Further, it is preferable that the holding member is provided in a longer edge of the bag main body.

Further, it is preferable that the ink discharge port of the holding member is equipped with an elastic member for sealing an opening of the ink outlet hole at a distal end part thereof and that a cap member is provide so as to hold the elastic member. In this case, it is preferable that an outer circumference surface of a cylindrical part has a stepped part for engaging with an engaging piece provided to the foregoing cap member. Further, it is preferable that the elastic member is formed of a columnar member of a rubber material such as silicone rubber, fluorine rubber, a butyl rubber, and the like. Further, the cap member is formed of a cylindrical member having a flange part for holding down the elastic member, and it is preferable that the cylindrical part has plural engaging piece bent inward.

The ink cartridge according to the present invention includes at least first and second case parts having similar external form, wherein these first and second case parts can be assembled together to form a single cartridge case or decomposed into individual parts. Thereby, the ink bag of the present invention is accommodated in the ink cartridge thus assembled by engaging the holding member of the ink bag with the engagement means provided to the first case part.

It should be noted that the ink-jet recording apparatus of the present invention has the feature that the ink cartridge is loaded from a front direction.

Further, it should be noted that the present invention provides an ink filling method for filling ink to an ink bag used with the ink cartridge of the present invention. It should be noted that the ink is filled from the ink filling opening in the state in which the holding member of the ink bag is engaged with the first case part.

Further, it should be noted that the present invention provides an ink refilling method for refilling ink to an ink bag used with the ink cartridge of the present invention, wherein the ink is refilled from the ink discharging port in the state in which the holding member of the ink bag is engaged with the first case part.

Further, the ink refilling method of the present invention refills the ink to the ink bag used with the ink cartridge of the present invention in such a manner that there is formed a rupture part or puncturing to a part of the bag main body of the ink bag and by sealing the rupture part after refilling of the ink through this rupture part.

Further, the manufacturing method of the ink cartridge of the present invention includes the step of attaching the second case part to the first case part after engaging the holding member of the ink bag filled with ink to the first case part.

Further, the recycling method of the ink cartridge of the present invention recycles the ink cartridge by disassembling the first and case parts from each other, removing the ink bag by disengaging the holding member of the ink bag from the first case part, and then engaging the holding member of the ink bag filled with the ink with the engaging part of the first case part, and further assembling the first and second case parts.

Another object of the present invention is to provide an ink bag holding member enabling stable accommodation of a flexible ink bag in an ink cartridge, an ink cartridge accommodating an ink bag provided with the foregoing ink bag holding member, and an ink-jet recording apparatus provided with such an ink cartridge.

In order to achieve the foregoing object, the ink bag holding member of the present invention used includes an ink filling opening used for filling ink to the bag main body and an ink discharge port for discharging the ink inside the bag main body, wherein the ink bag holding member further includes an engaging part for engagement with the engaging means provided to at least one of the case half bodies constituting a cartridge case together with another case half body.

Here, it is preferable that this holding member is fixed to one edge of the bag main body having a generally square form by thermal welding process in such a manner that it is held by the case detachably. Further, it is preferable that this holding member has a connection part having a tapered edge at the part welded to the bag main body. It is further preferable that the connection part, the ink filling opening and the ink discharge port are formed integrally to different surfaces of a flange part. Further, it is desirable that there is formed a groove on a side surface of the flange part. Also, it is preferable that the ink filling opening is sealed with thermal welding.

Further, it should be noted that the ink cartridge of the present invention is the one that accommodates therein the ink bag of the present invention having the ink bag holding member.

Further, it should be noted that the ink-jet recording apparatus of the present invention has the feature that the ink cartridge of the present invention can be loaded from a front side.

Another object other than the present invention is to provide an ink cartridge allowing easy reuse of the case and simultaneously capable of supplying ink stably without causing leak, and an ink-jet recording apparatus using such an ink cartridge.

In order to achieve the object as noted above, the present invention provides an ink cartridge formed of divided case half bodies having the means for holding a holding member in at least one of said case half bodies, said holding member being formed with an ink discharge port, wherein there is provided an elastic member for sealing an opening at a distal end part of an ink outlet forming the ink discharge port in the holding member, and a cap member is attached to the ink discharge port for holding down the foregoing elastic member.

Here, it is preferable to provide a stepped part on a circumference part of the ink discharge port for allowing engagement with an engaging piece provided to the cap member. Further, the elastic member is preferably formed of a rubber material such as silicone rubber, fluorine rubber, a butyl rubber, and the like. Further, the cap member is preferably formed of a cylindrical member having a flange part for holding down the elastic member, and it is preferable that the cylindrical part has plural engaging piece bent inward.

Further, the ink-jet recording apparatus of the present invention is constructed so as to enable loading of the ink cartridge of the present invention from a front side.

Another object of the present invention is to provide an ink bag wherein wasting of unused ink is minimized, capable of being attached and removed to and from a protection cover easily and stably, and capable of conducting stabilized ink supply. Further, the present invention provides an ink cartridge accommodating the ink bag and an image formation apparatus using such an ink cartridge.

In order to achieve the above object, the ink bag regarding the present invention has the construction in which a holding member is fixed to a bag main body having flexibility such that the holding member has an ink filling opening used for filling the bag main body with ink and an ink discharge port for discharging the ink inside the bag main body, wherein the ink bag further has an engagement part for holding the ink bag to a cartridge case formed of divided case half bodies, in which the ink bag is accommodated.

Here, the ink discharge port includes a cylindrical part forming an outlet hole for discharging the ink inside the bag main body and it is preferable that this cylindrical part is formed with a material that does not exert influence on the properties of the ink. In this case, it is preferable that the cylindrical part has a holding part holding an elastic member inserted to the outlet hole for the purpose of sealing as a unitary body.

Also, it is preferable that the ink discharge port has an elastic member sealing the outlet hole used for discharging the ink inside the bag main body and that this elastic member is formed with a material that does not exert influence on the properties of the ink. In this case, the elastic member is preferably formed of a rubber material such as a silicone rubber or a silicone based rubber that does not exert influence on the properties of the ink.

Furthermore, it is preferable that the ink discharge port has a cap member covering at least a part of the elastic member that seals the outlet hole for discharging the ink inside the bag main body, and that the cap member is formed with a material not exerting influence on the properties of the ink. In this case, it is preferable that a stepped part is formed on the circumference surface of the ink discharge port for engagement with an engaging piece provided to the cap member. Further, it is preferable that the cap member is formed of a cylindrical member having a flange part holding down the elastic member and that the cylindrical part has plural engaging piece bent inward.

Further, it is preferable that the ratio (D:D') of the outer diameter D of the elastic member and the inner diameter D' of the part to which this elastic member is inserted falls in the range of 1:0.85-1:0.92, and that it is further preferable that the ratio (t:H) of the thickness t of the elastic member and the depth H of the part to which this elastic member is inserted falls in the range of 1:0.77-1:1.

Furthermore, it is preferable that the diameter d of the hollow needle pierced into the elastic member for causing the ink inside the bag main body to flow is set such that the ratio of the diameter d of the hollow needle and the outer diameter D the elastic member (d:D) falls in the range of 1:3-1:10, and that the ratio (d:t) of the diameter d of the hollow needle and the thickness t of the elastic member falls in the range of 1:1.5-1:3.5.

Further, it is preferable that the holding member of the ink bag is held in the state that the ink discharge port is located generally at the center of the cartridge case held in the upright direction.

Further, it is preferable that the ink filling opening is sealed by welding in the state that ink is filled in the bag main body of the ink bag.

The ink cartridge according to the present invention for accommodating the ink bag comprises at least first and second case half bodies having a similar external form in such a manner that these first and second case bodies can be assembled together and decomposed into individual case bodies, wherein the ink bag of the present invention is accommodated in the ink cartridge in such a manner that the holding member of the ink bag is engaged with the engagement holding means provided to the first case half body.

Further, the image formation apparatus of the present invention has the construction such that the ink cartridge of the present invention is loaded.

Here, it is preferable that the ink cartridge is loaded from the front side of the main body of the image formation apparatus.

Other objects, features and advantages of the present invention will become more apparent from the following detailed description when read in conjunction with the accompanying drawings.

BEST MODE FOR CARRYING OUT THE INVENTION

Hereinafter, an embodiment of the present invention will be described with reference to the attachment drawings.

FIRST EMBODIMENT

Figure 2:
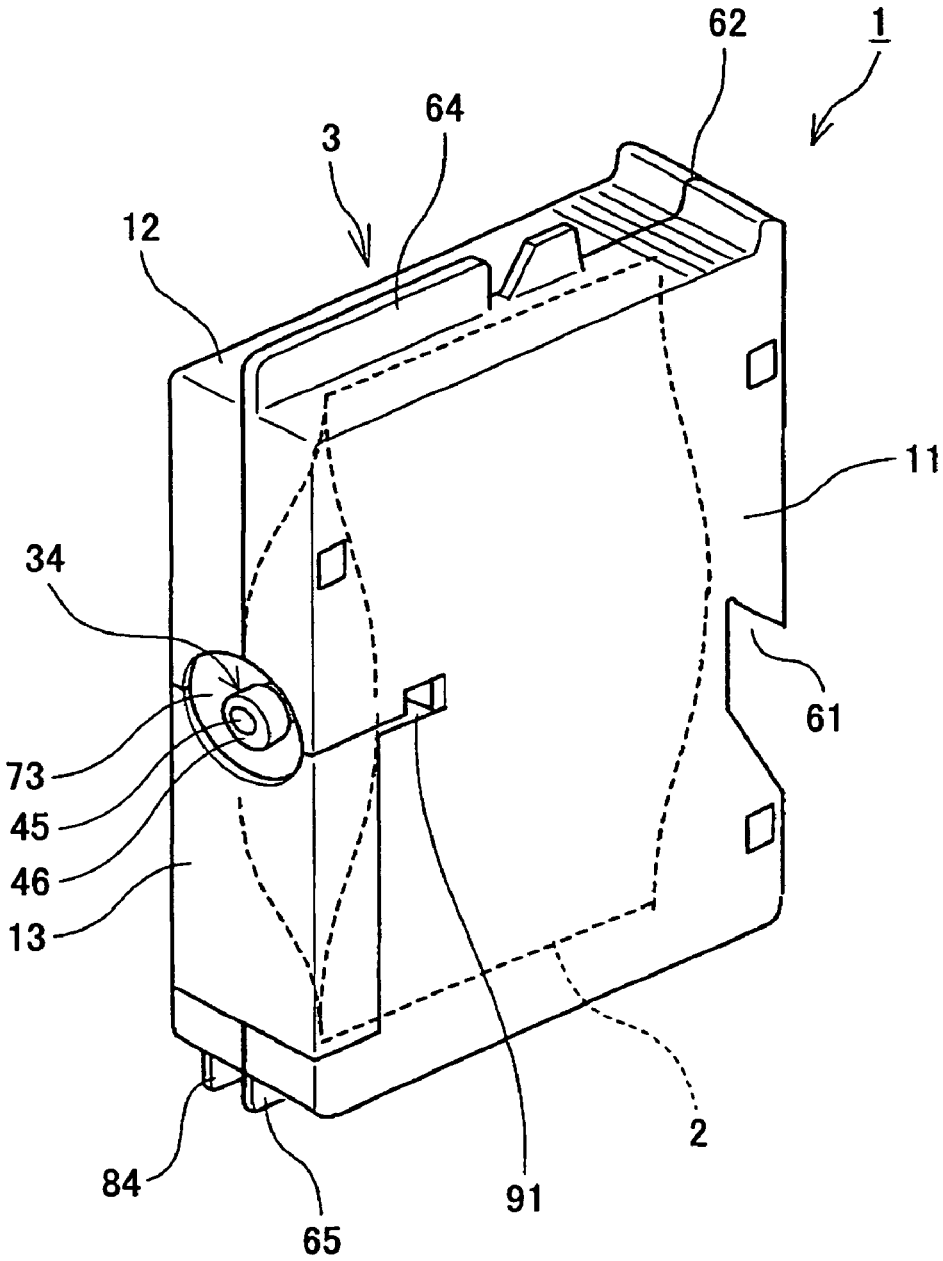
FIG. 2 is a diagram showing the appearance of an ink cartridge according to the present invention in an oblique view.
Figure 3:
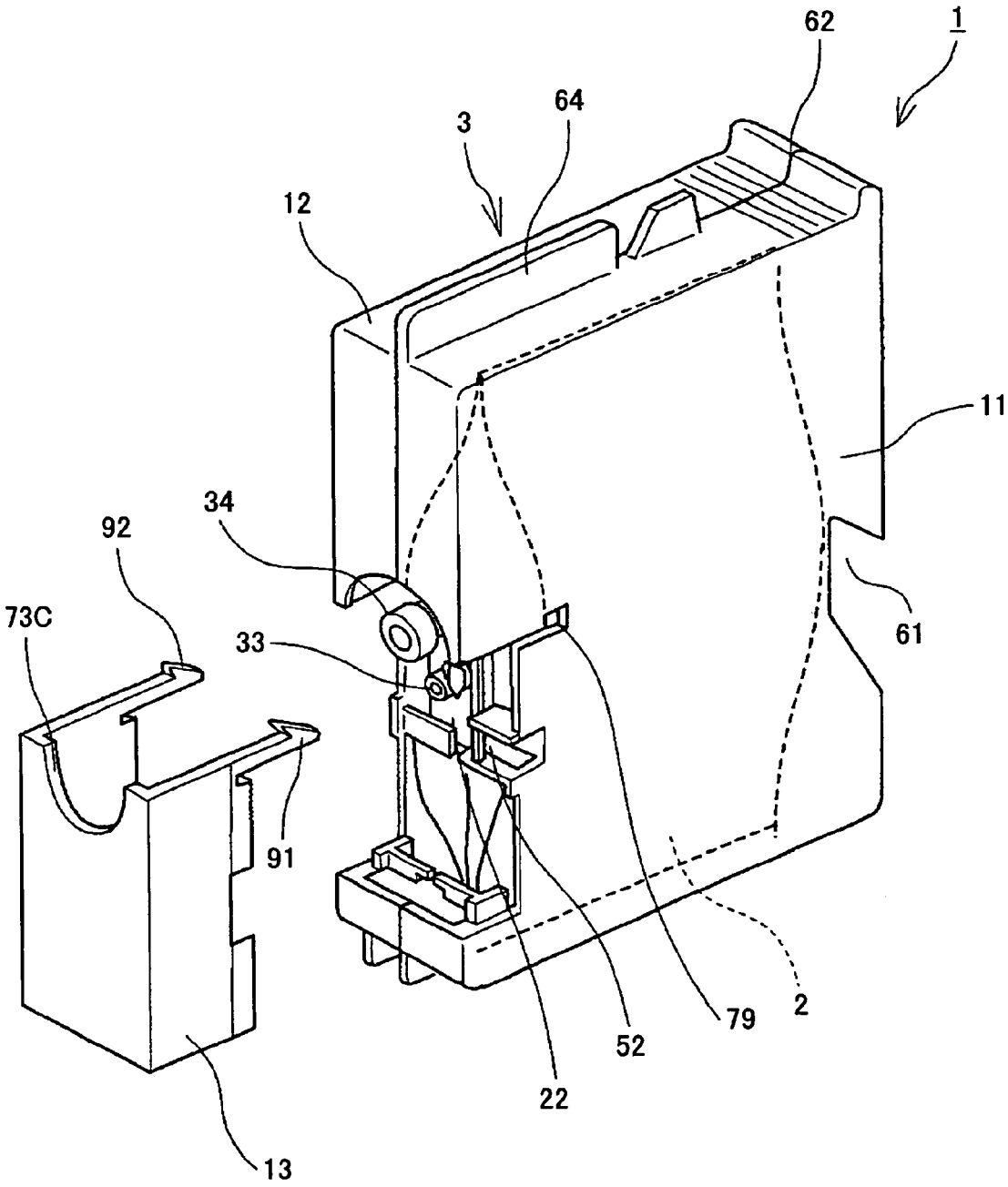
FIG. 3 is a diagram showing the same ink cartridge in the state in which a third case part thereof is removed.
Figure 4:
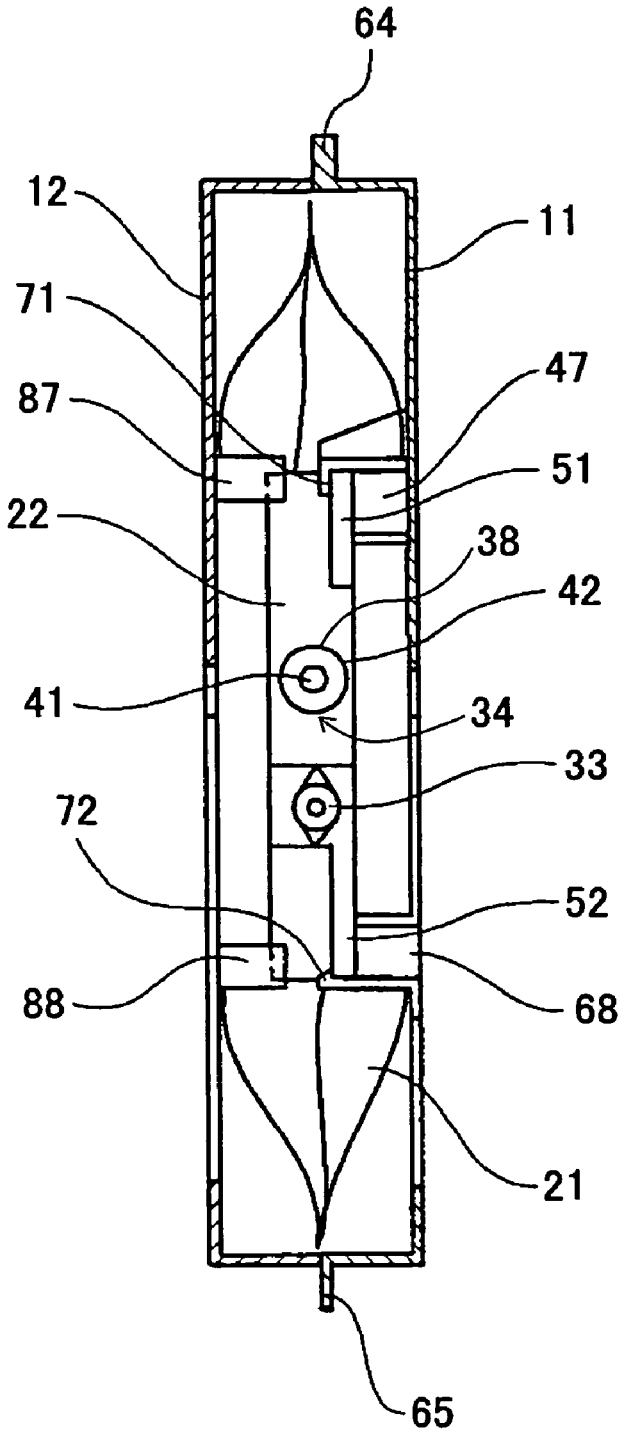
FIG. 4 is a front cross-sectional diagram showing the same ink cartridge from a front direction.

FIG. 2 is a diagram showing an appearance of an ink cartridge according to the present invention in an oblique view, FIG. 3 is a schematic oblique view showing the ink cartridge of FIG. 2 in the state in which a third case part is removed, FIG. 4 is a front cross-sectional view of the same ink cartridge.

Referring to the drawings, this ink cartridge 1 includes an ink bag 2 filled with ink and a case 3 accommodating the ink bag 2. The case 3 is formed of a first case part 11, a second case part 12 and a third case part 13, wherein the first case part 11 and the second case part 12 form together a case part acting as a protection cover protecting a side of the ink bag 2. Thus, the case 3 accommodating the ink bag 2 is split into the first case part 11 and the second case part 12 along a plane parallel to the ink supply direction (ink discharge direction).

Figure 5:
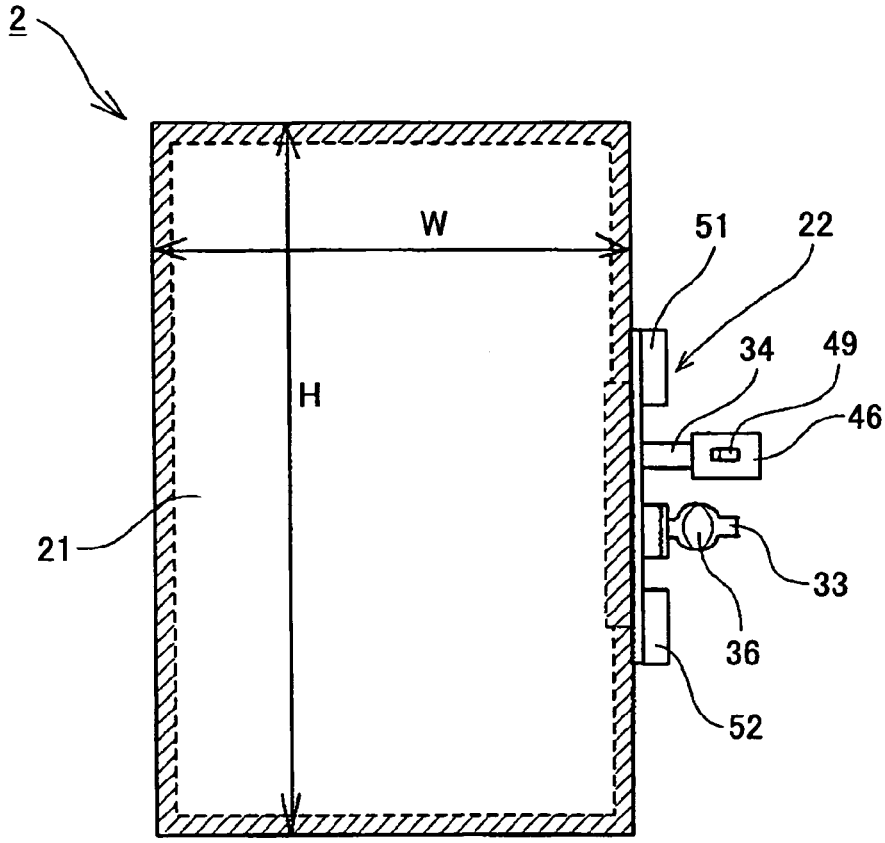
FIG. 5 is a diagram showing a side view of the ink bag according to the present invention.
Figure 6:
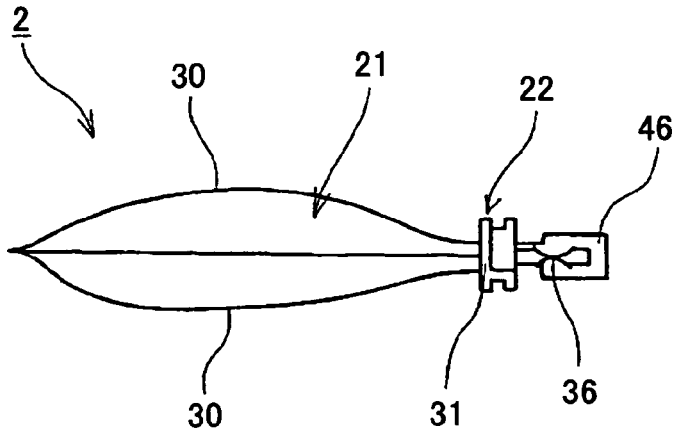
FIG. 6 is a diagram showing the ink bag of FIG. 5 from the lower direction for the purpose of explaining the state in which ink is filled in the ink bag.
Figure 7:
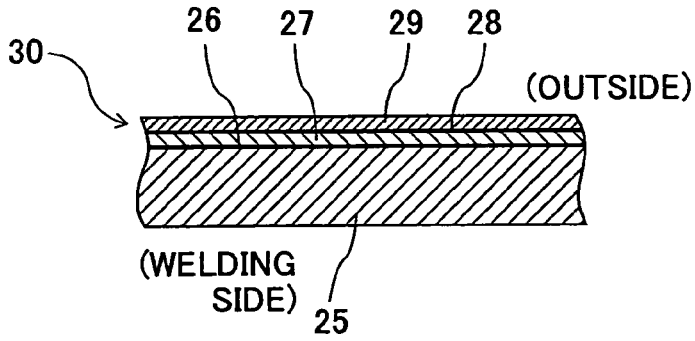
FIG. 7 is a cross-sectional diagram showing an aluminum laminate film that constitutes the bag main body of the ink bag of the present invention.
Figure 8:
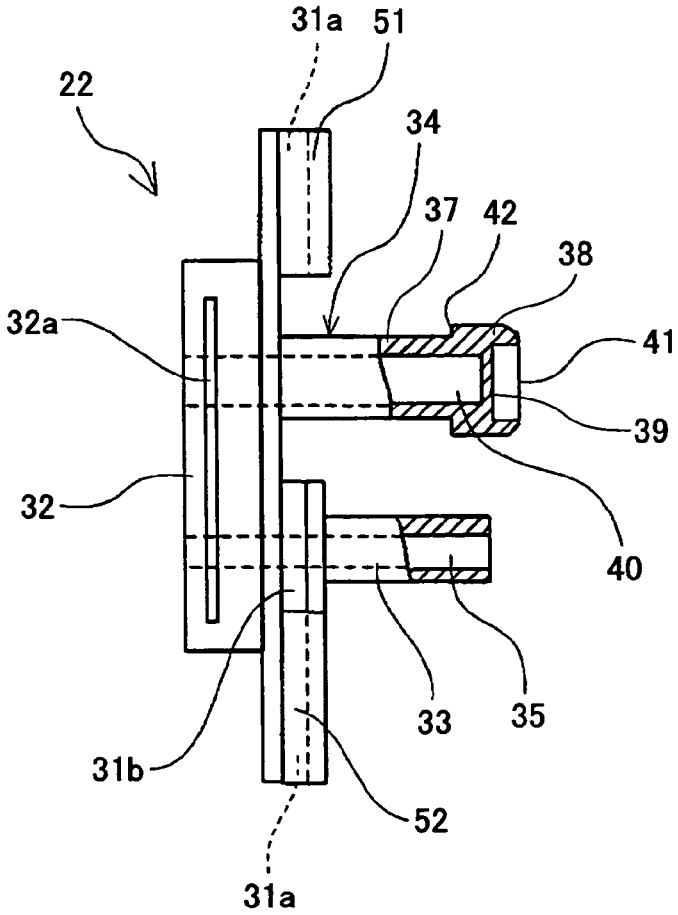
FIG. 8 is a diagram showing a holding member of the ink bag in a side view.
Figure 9:
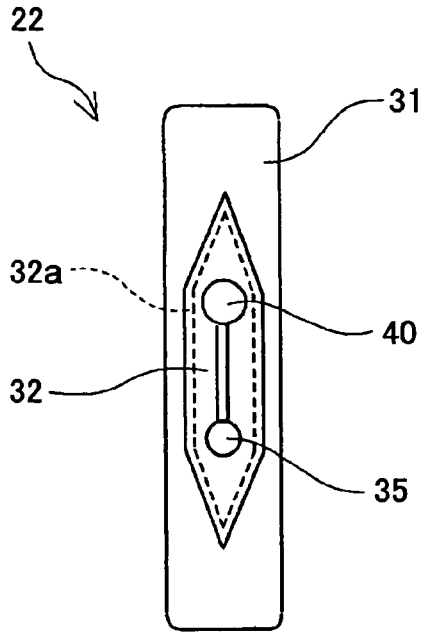
FIG. 9 is a diagram showing the holding member of FIG. 8 from a rear direction.
Figure 10:
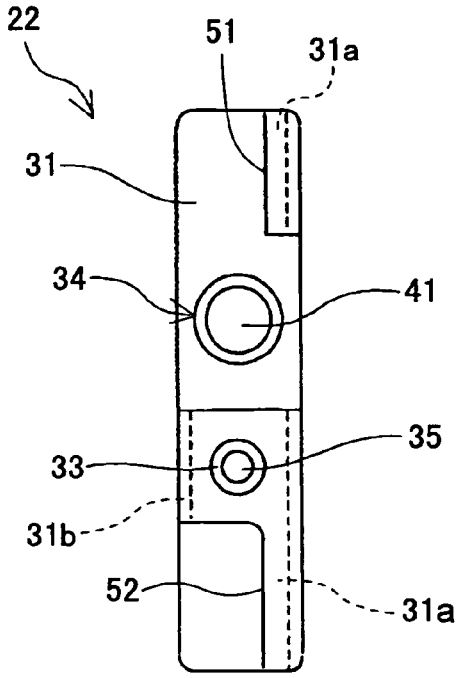
FIG. 10 is a diagram showing the holding member of FIG. 8 from a front direction.
Figure 11:
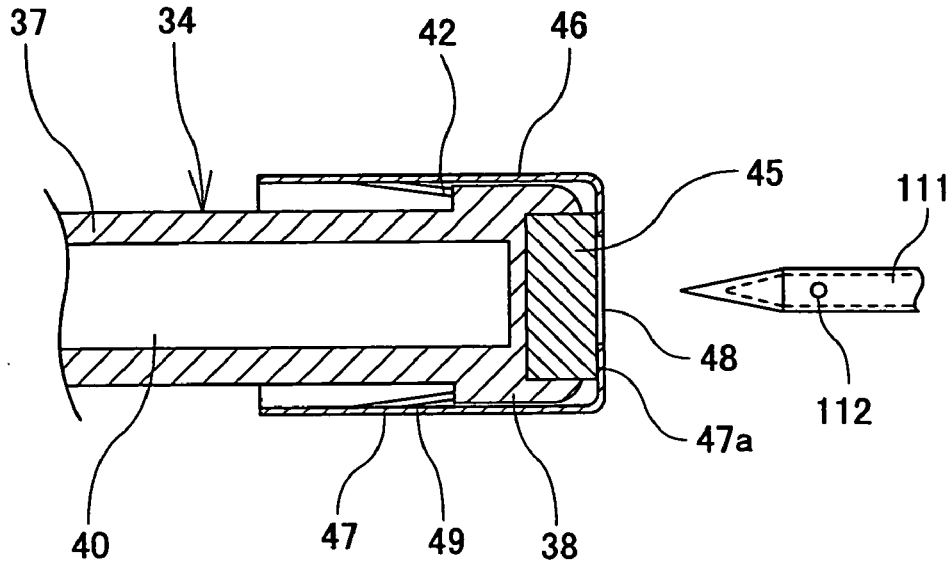
FIG. 11 is a diagram showing a part of an ink discharge port of the same ink bag in a cross-sectional diagram.
Figure 12:
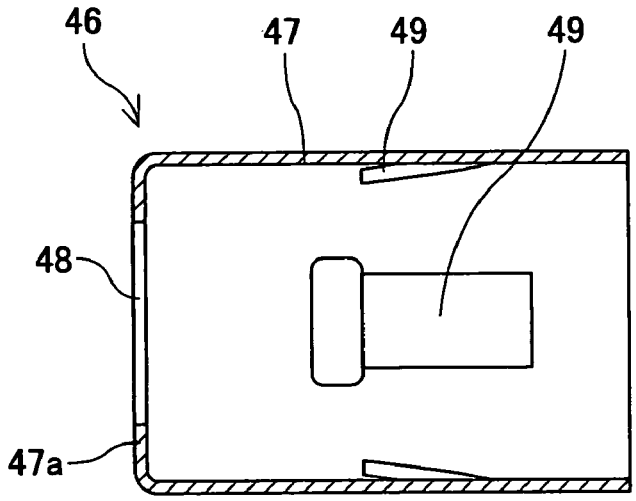
FIG. 12 is a cross-sectional diagram showing a cap member provided to the ink discharge port.
Figure 13:
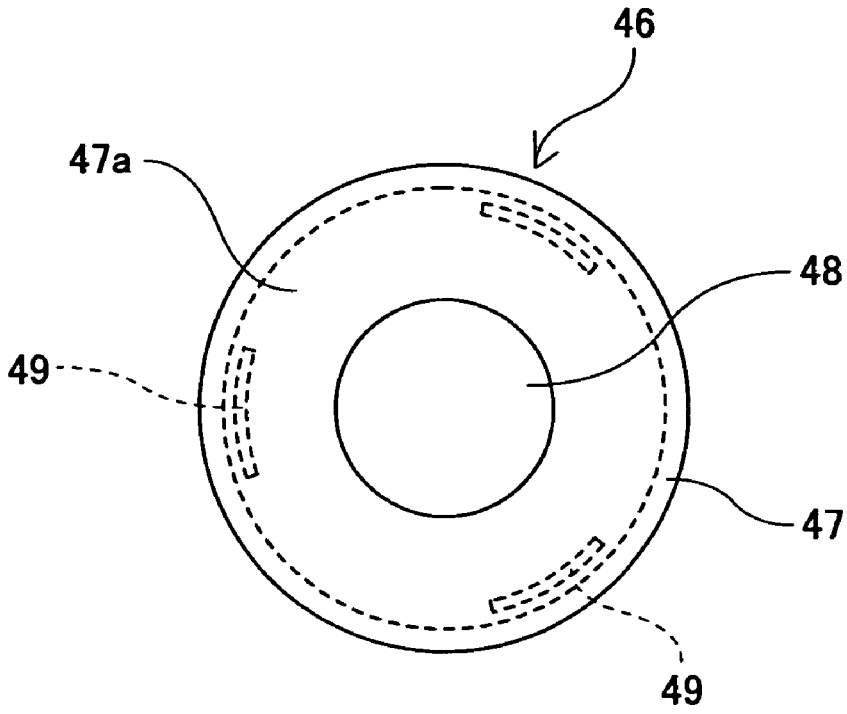
FIG. 13 is a diagram showing the same cap member in a front view.

First, an example of the ink bag 2 of the present invention will be explained with reference to FIGS. 5 through 13, wherein FIG. 5 is a side view diagram of the same ink bag, FIG. 6 is a diagram showing the ink bag of FIG. 5 as viewed from a downward direction in the state filled with the ink; FIG. 7 is a cross-sectional diagram of the aluminum laminate film constituting the bag main body of the ink bag, FIG. 8 is a side view diagram of a holding member of the ink bag, FIG. 9 is a diagram showing the holding member of FIG. 8 as viewed from a rear direction, FIG. 10 is a diagram showing the holding member of FIG. 8 from a front direction, FIG. 11 is a cross-section diagram showing an ink discharge port of the ink bag, FIG. 12 is a cross-sectional diagram of a cap member provided to the ink discharge port of FIG. 11, and FIG. 13 is a diagram showing the cap member as viewed from a front direction thereof.

As shown in FIGS. 5 and 6, the ink bag 2 includes a flexible bag main body 21 of an aluminum laminate film having a generally square form (rectangular form in the present example) and a holding member 22 of a resin material is fixed (welded) to the longer edge of the bag main body.

As shown in FIG. 7, the bag main body 21 is formed of an aluminum laminate film 30 having a structure in which a dry lamination 26, an aluminum film 27, a dry lamination 28, and a PA (polyamide) film 29 are stacked consecutively on a LDPE (low-density polyethylene) base 25. Thereby, two such aluminum laminate films 30 and 30 are welded with each other at the surrounding parts (shaded region of FIG. 2) and further to the holding member 22, and as a result, there is formed a bag as shown in FIGS. 5 and 6.

It should be noted that, with this bag main body 21, there is provided no frame body for maintaining the form of the bag, contrary to the conventional bag, and as a result, the bag has high flexibility for the entire part thereof. With this, the present invention can minimize the waste ink remaining in the bag unused.

Here, it should be noted that, although the bag main body 21 is formed of the aluminum laminate film 30 in the present example, the material used for the bag main body 21 is by no means limited to the foregoing. Yet, it is desirable to form the bag main body with a material including at least the aluminum laminate film.

Further, it is preferable to set the ratio (W/H) of the width W to the height H of the bag main body 21 to fall within the range of $1 \leqq W/H \leqq 1.5$ or $1.5 \leqq 1$ in view of securing sufficient hydrostatic pressure and minimizing the ink residual amount.

Here, the relationship between the form of the bag main body 21 and the hydrostatic pressure at the ink discharge port will be explained withy reference to FIGS. 14 and 15.

Figure 14:
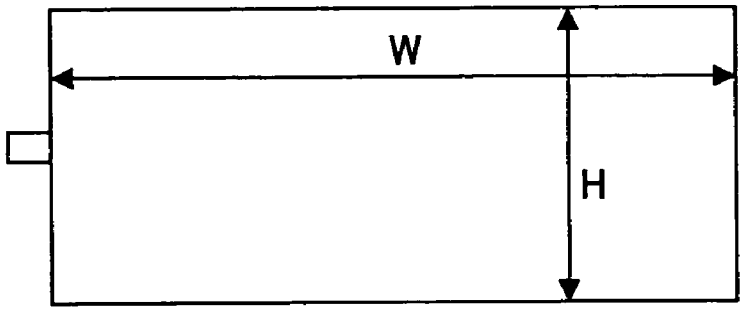
FIG. 14 is a diagram explaining measurement of the relationship between the length-to-breadth ratio of the ink bag and the hydrostatic pressure.

In the present example, the form of the bag main body 21 is determined to have an oblong shape (width W being larger than height H) as shown in FIG. 14. Thus, three kinds of bag main bodies are prepared in the experiment, ① one having the height H×width W of 90×116 (1:1.29), ② one having the height H×width W of 70×106 (1:1.5), and ③ one having the height H×width W of 50×126 (1:2.52). Further, two cases (thin type and thick type) having different thicknesses are prepared 2 for the case 3.

Further, the relationship between the ink residual amount and the hydrostatic pressure at the ink discharge port was measured for various combinations of the bag main bodies and the cases. The result of this is shown in FIG. 15. Here, it should be noted that no measurement was made about the combination of the size of 50×126 and the thick case.

For stabilized supply of ink to the sub tank, it should be noted that the use of the hydrostatic pressure of about 0 ($gf/cm^2$) is preferable at the ink discharge port.

Figure 15:
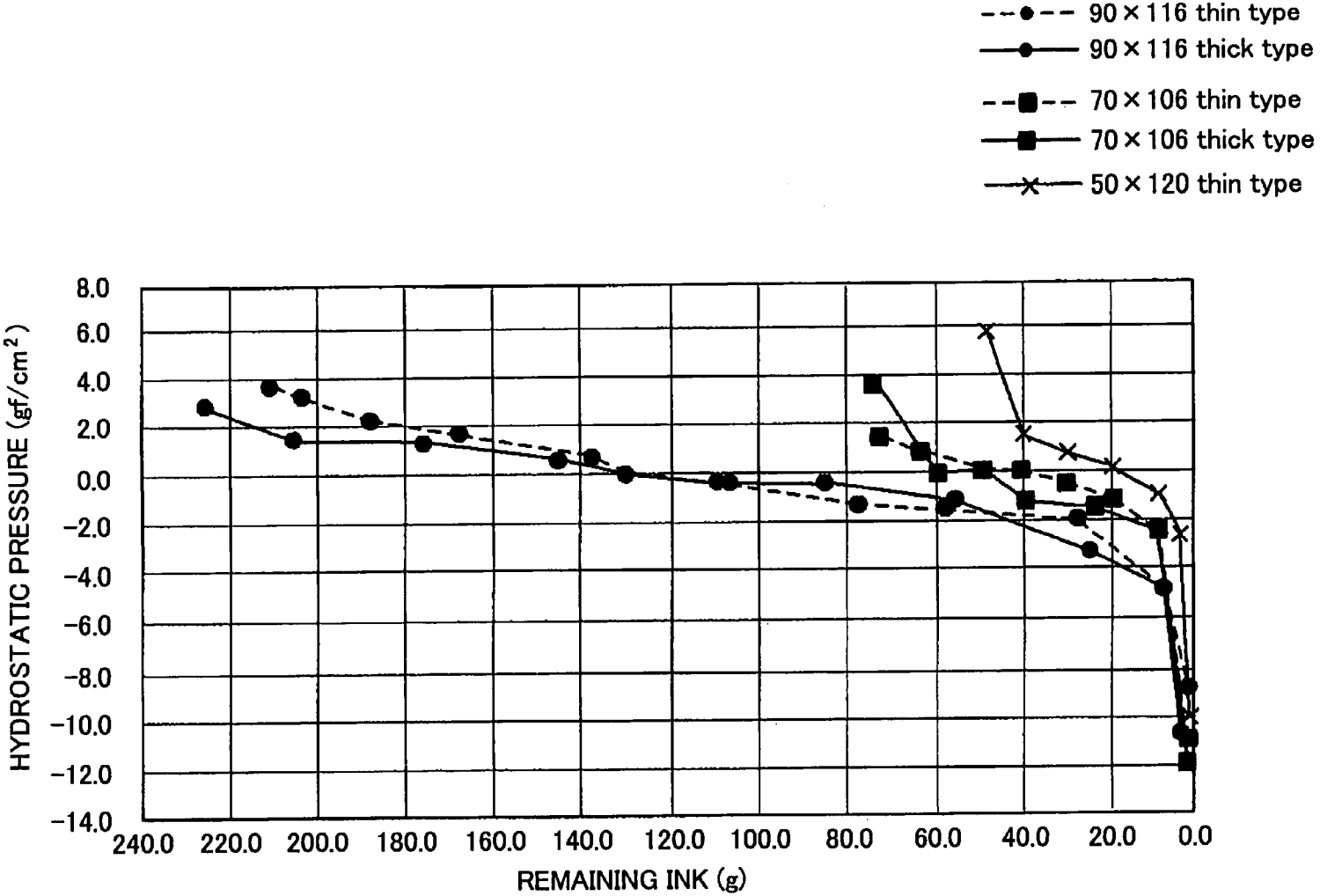
FIG. 15 is a diagram showing an example of measurement of the relationship between the length-to-breadth ratio and the hydrostatic pressure of the ink bag.

Now, evaluating the result of FIG. 15, it can be seen that a stabilized hydrostatic pressure is achieved irrespective of the ink residual amount in the vicinity of 0 ($gf/cm^2$) in the case ① in which the width (W)-to-height (H) ratio (W/H) of the bag is 1:1.29, while in the case ② in which the width-to-height ratio (W/H) of the bag main body is 1:1.5, it can be seen that there occurs a steep rise of hydrostatic pressure at the ink discharge port to the value of 2 ($gf/cm^2$) (thin type) or 4 ($gf/cm^2$) upon filling of the ink of about 70 g, which amount being smaller than the target amount of 100 g. Also, in the bag main body of the case ③ above in which the width-to-height ratio (W/H) is set to 1:2.52, there occurs a steep rise of the hydrostatic pressure at the ink discharge port when about 50 g of the ink is filled in the attempt of filling the target amount of 100 g.

From this, it can be seen that, although it depends on the thickness of the case 3, the width-to-height ratio (W/H) of the bag main body 21 falls within the range of 1-1.5.

It should be noted that the holding member 22 constitutes a unitary connection part 32 for welding the bag main body 21 to one side of the flange part 31 as shown in FIGS. 8 through 10, and a hollow ink filling opening 33 and a hollow ink discharge port 34 are formed to the other side of the flange part 31 as a unitary body (represented in the state before the welding).

Here, it should be noted that the connection part 32 has a generally chestnut form by tapering both end parts (ends of the longer edges) of the holding member 22 as shown in FIG. 9. Further, a depression 32*a* is formed at the circumference surface. With this, it becomes possible to weld the aluminum laminate films 30 and 30 forming the bag main body 21 to the circumference surface of the connection part 32 without interruption.

Within the ink filling opening 33, there is formed a pierce hole 35 used for filling the ink such that the hole 35 penetrates through the flange part 31 and also through the connection department 32, and the ink filling opening 33 is sealed (indicated in FIGS. 5 and 6 as seal part 36) by welding after filling the ink to the ink bag 2. By sealing the ink filling opening 33 by the thermal welding process, a reliable seal is obtained easily.

Referring to FIG. 11, the ink discharge port 34 has a cylindrical part 37 and a seal member holding part 38 forming a unitary body thereto, and a compartment 39 is formed between the cylindrical part 37 and the seal member holding part 38. Further, an ink outlet hole 40 is formed in the cylindrical part 37 so as to penetrate through the flange part 31 and the connection department 32, and an opening 41 is formed in the seal member holding part 38 for inserting an elastic member 45 that seals the ink outlet hole 40. Further, a stepped part 42 is formed to the circumference surface so as to mount a cap member between the cylindrical part 37 and the seal member holding part 38.

As shown in FIG. 11, the elastic member 45 is inserted into the opening 41 of the seal member holding part 38 of the ink outlet port 34 for sealing the ink outlet hole 40, and the elastic member 45 is covered with a cap member 46.

The elastic member 45 has a form capable of maintaining seal and may have any of columnar form (circular section), triangular columnar form, a square columnar form, a pentagram columnar form, a hexagonal columnar form, a heptagonal columnar form, an octagonal columnar form, and the like.

The cap member 46 has a cylindrical part 47 having a flange part 47*a* holding down a rim part of the elastic member 45 as shown in FIGS. 12 and 13, wherein there is formed a hole 48 at the inner circumferential surface of the flange part 47*a* for plugging in a supply needle from the side of the recording apparatus. Further, plural engaging pieces 49 bent inward are formed in the cylindrical part 47. It should be noted that the form of the hole 48 is not limited to circle but any of triangle, square, pentagon, hexagon, heptagon, octagon, and the like may be used.

By inserting this cap member 46 into the holding part 38 of the ink discharge port 34, the engaging piece 49 engages with a stepped part 42 formed between the cylindrical part 37 of the ink discharge port 34 and the holding part 38 as shown in FIG. 11, and with this, the cap member 46 no longer comes off.

Here, it should be noted that the cylindrical part 37 and the holding part 38 of the ink discharge port 34 is formed of a material that does not exert influence on the properties of the ink such as high density polyethylene. With this, dissolution of the cylindrical part 37, and the like, formed with the outlet hole 40 and exposed constantly to the ink, into the ink is prevented.

Also, it is preferable that the elastic member 45 is formed of a material not exerting influence to the properties of the ink, such as silicone or a rubber material based on silicone. With this, the problem that the elastic member forming the seal member, which is constantly exposed to the ink, is dissolved into the ink and causes clogging is eliminated.

As shown in FIG. 11, this elastic member 45 enables the supply of the ink to the recording apparatus while maintaining the sealed state, when a hollow supply needle 111 is stabbed from the side of the recording apparatus as the ink introduction means used for introducing ink into the recording apparatus.

Here, the elastic member 45 is required to maintain the sealed state with reliability even when the hollow needle 111 is drawn out after stabbing, in view of the possibility that the hollow needle 111 is left in the stabbed state or the hollow needle 111 once stabbed is left after being pulled out.

Figure 16:
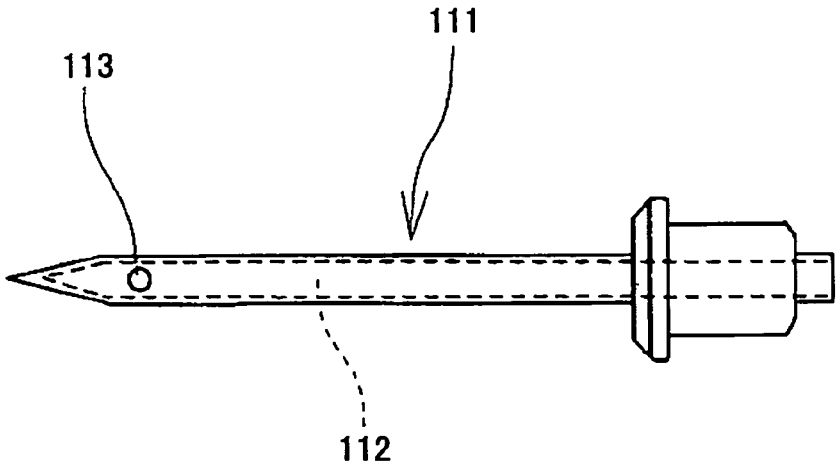
FIG. 16 is a side view diagram of the hollow needle.
Figure 17:
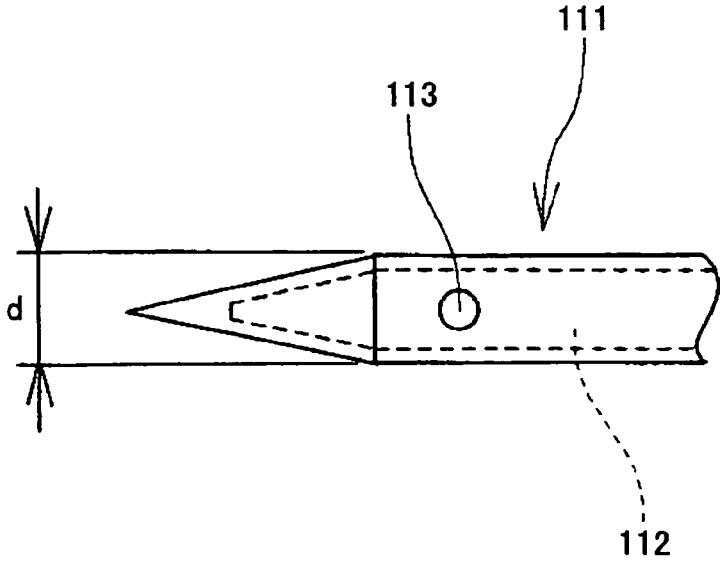
FIG. 17 is an enlarged view showing a tip end part of the hollow needle.

Here, explanation will be made on the hollow needle 111 with reference to FIGS. 16 and 17.

Referring to the drawings, this hollow needle 111 is a cylindrical member formed with an ink introduction path 112 therein and has an ink injection hole 113 formed at the distal circumferential surface. By forming the ink injection hole 113 on the side surface at the distal end part of the hollow needle 111, the needle can be formed to have a sharp point at the tip end thereof, and it becomes possible to pierce the needle 111 into to the elastic member 45 easily without causing defect or void therein. Further, there occurs no problem that the elastic member 45 is damaged and the damaged piece cause clogging of the ink introduction hole 113.

Further, it should be noted that the cap member 46 is forming with a material, such as stainless steel that does not exert influence on the properties of the ink. With this, it becomes possible to prevent erosion or corrosion even in the case the flange part 47*a* contacting the elastic member 45 has contacted with the ink.

Here, explanation will be made on the result of the experiment with regard to the material of the elastic member 45.

In the experiment that uses an elastic material of EDPM+Si for the elastic member 45 provided in the ink discharge port 34 of the ink bag 1, it was observed that ink leakage has been caused at the needle hole in the case the hollow needle 111 is removed after leaving the elastic member 45 for about one week in the state stabbed with the hollow needle 111 at the temperature of 50° C. under the humidity of 35%.

Thereupon, the inventor of the present invention has conducted experiments for confirming whether or not there occurs passage of light in a rubber plate stabbed with a hollow needle 111 when the hollow needle 111 has been pulled out after leaving 3 days at the temperature of 50° C. under the humidity of 35% in the state stabbed with the hollow needle, for various rubber materials including: EPDM+Si (hardness 40°, thickness t=2 mm); EPDM+Si (hardness 50°, thickness t=2 mm); a fluorine rubber (hardness 55°, thickness t=2 mm); a butyl rubber (hardness 50°, thickness t=2 mm); a silicone rubber (marketed product with unknown hardness, thickness t=2 mm); a silicone rubber (hardness 40°, thickness t=2 mm); and a silicone rubber (hardness 50°, thickness t=2 mm).

Table 1 below summarizes the foregoing results, wherein it should be noted that X represents the case in which passage of light was observed, while ○ represents no light passage of light was observed.

TABLE 1

| Material | evaluation |
|---|---|
| EPDM + Si (40°, t = 2 mm) | X |
| EPDM + Si (50°, t = 2 mm) | X |
| fluorine (55°, t = 2 mm) | X |
| butyl (50°, t = 2 mm) | X |
| commercial silicone (t = 2 mm) | ○ |
| silicone (40°, t = 2 mm) | ○ |
| silicone (50°, t = 2 mm) | ○ |

From the result of this Table 1, it was confirmed, with the elastic member of (EDPM+Si), that the hole stabbed with the hollow needle has caused creep deformation. Also, in this case, it was confirmed that, although it is possible to reduce the hole diameter to some extent by inserting the elastic member by compressing toward the diameter direction, it is not possible to avoid increase of deformation with elapsing of time.

On the other hand, it was confirmed that there occurs no ink leakage by insertion or withdrawal of the hollow needle when a Si rubber is used as the elastic member 45.

Figure 18:
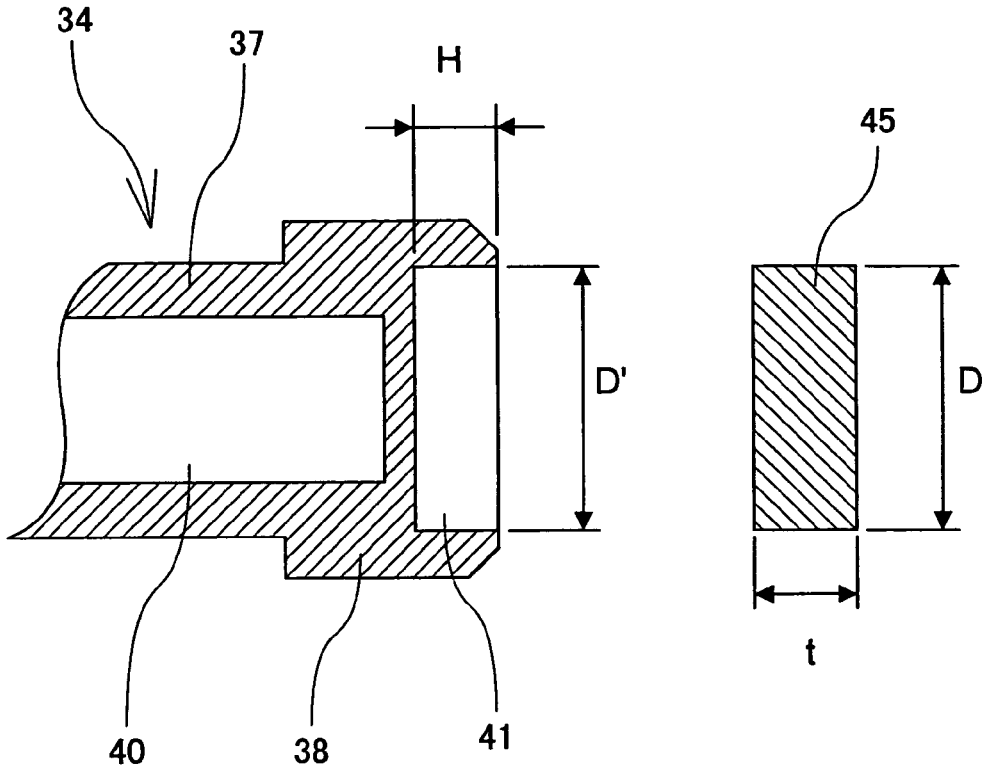
FIG. 18 is an enlarged view for explaining the relationship between the holding part and the cap member.

Next, explanation will be made with reference to FIG. 18 with regard to the relationship between the outer diameter D of elastic member 45 and the inner diameter D' of the opening 41 of the holding part 38 to which the elastic member 45 is inserted.

As aforementioned, the elastic member 45, to which the hollow needle 111 is inserted and pulled out, is required to restore the original sealed state when the hollow needle 111 is pulled out for avoiding ink leakage. Therefore, it is preferable that the elastic member 45 is inserted into the opening 41 of the holding part 38 in the state compressed in the diametrical direction.

Thus, evaluation was made with regard to the light passage by changing the outer diameter D of the elastic member 45 and the inner diameter D' of the opening 41 of the holding part 38 to which the elastic member 45 is inserted. In this experiment, a silicon rubber is used for the material of the elastic member 45.

Table 2 below summarizes the result.

TABLE 2

| Outer diameter D of elastic member | Inner diameter D' of holding part | D'/D | evaluation |
|---|---|---|---|
| 5.5 | 4.5 | 0.82 | X |
| 5.4 | 4.6 | 0.85 | ○ |
| 5.3 | 4.7 | 0.89 | ○ |
| 5.2 | 4.8 | 0.92 | ○ |
| 5.1 | 4.9 | 0.96 | X |

As will be noted from Table 2, it is preferable to set the ratio (D:D') between outer diameter D of the elastic member 45 and the inner diameter D' of the opening 41 of the holding part 38 to fall in the range of 1:0.85-1:0.92.

Thus, when the ratio (D'/D) is less than 0.85, the compression of the elastic member 45 becomes excessive and it becomes difficult to insert the elastic member 45 into the opening 41. When the ratio (D'/D) exceeds 0.95, on the other hand, the compression of the elastic member 45 becomes too small and restoration of the sealed state becomes insufficient and it was confirmed that there can occur ink leakage.

Next, the relationship between the thickness t of the elastic member and the depth (height) H of the opening 41 of the holding part 38 to which the elastic member is inserted will be explained with reference to FIG. 18.

It should be noted that the elastic member 45 is held, after being inserted into the opening 41 of the holding part 38, by the flange part 47*a* of the cap member 46, while the cap member 46 is held on the circumference of the holding part 38 as a result of engagement of the engaging piece 49 with the stepped part 42.

Thus, in the case the thickness t of the elastic member 45 is equal to or smaller than the depth (height) H of the opening 41 of the holding part 38, it becomes no longer possible to hold the elastic member 45 by the cap member 46. On the other hand, in the case the compression of the elastic member 45 in the thickness direction is excessive, there is a risk that the cap member 46 may come off with the restoration force of the elastic member 45.

Next, the thickness t of the elastic member 45 and the depth H of the opening 41 of the holding part 38 to which the inserts elastic member 45 is inserted is changed variously with each other and evaluation was made with regard to the transmission of the light. In the experiment, a silicone rubber was used for the material of the elastic member 45.

Table 3 shows the result of the experiment.

TABLE 3

| Thickness t of the elastic member | Depth H of holding part | H/t | evaluation |
|---|---|---|---|
| 2.8 | 1.65 | 0.59 | X |
| 2.6 | 1.75 | 0.67 | X |
| 2.4 | 1.85 | 0.77 | ○ |

TABLE 3-continued

| Thickness t of the elastic member | Depth H of holding part | H/t | evaluation |
|---|---|---|---|
| 2.2 | 1.95 | 0.89 | ○ |
| 2.1 | 20.5 | 0.98 | ○ |
| 2.0 | 2.10 | 1.03 | X |

As will be understood from Table 3, it is preferable that the ratio (t:H) between the outer diameter D of the elastic member 45 and the depth H of the opening 41 of and holding part 38 falls in the range of 1:0.77-1:1.

When the ratio (H/t) is less than 0.77, the compression of the elastic member 45 becomes excessive and there may be caused problems such as the engaging piece 49 of the cap member 46 being deformed. When the ratio exceeds 1, on the other hand, it becomes no longer possible to hold the elastic member 45 with the cap member 46.

Next, the relationship between the diameter d of the hollow needle (see FIG. 17) and the outer diameter D of the elastic member will be explained.

As aforementioned, it is necessary for the elastic member 45 to set the relationship between the diameter of the hollow needle 111 and the diameter of the elastic member appropriately in view of the fact that the hollow needle 111 is stabbed thereto and pulled out therefrom, such that damaging of the elastic member 45 is avoided.

Thereupon, experiment was made by changing the diameter D of the elastic member 45 while maintaining the diameter d of the hollow needle 111 constant. In this experiment, a silicon rubber was used for the material of the elastic member 45.

Table 4 shows the result of the experiment.

TABLE 4

| Diameter d of hollow needle | Outer diameter D of elastic member | D/d | evaluation |
|---|---|---|---|
| 1.28 | 2.56 | 2 | X |
| | 3.20 | 2.5 | X |
| | 3.84 | 3.0 | ○ |
| | 5.20 | 4 | ○ |
| | 8.96 | 7 | ○ |
| | 12.80 | 10 | ○ |
| | 15.36 | 12 | X |

As will be understand from this Table 4, it is preferable to set the ratio (d:D) between the diameter d of the hollow needle and the outer diameter D of the elastic member to fall in the range of 1:3-1:10.

When the ratio (D/d) has become less than 3, the margin of the elastic member 45 surrounding the hollow needle 111 is reduced, and the elastic member 45 easily undergoes cracking. When the ratio has exceeded 10, on the other hand, the stability of the hollow needle 111 in the diametrical direction of the elastic member 45 becomes poor at the time the hollow needle 111 is inserted.

Next, explanation will be made on the relationship between the diameter d of the hollow needle and the thickness t of the elastic member, As aforementioned with regard to the elastic member 45, it is necessary to set the relationship between the diameter of the hollow needle 111 and the thickness of the elastic member appropriately, in view of the fact that the hollow needle 111 is inserted and pulled out and that the hollow needle 111 has to penetrate through the elastic member 45, that invasion of the hollow needle 111 is not hindered and that the sealed state is maintained even when the hollow needle 111 is drawn out.

Thereupon, experiment was made in which the thickness t of the elastic member 45 is changed variously while maintaining the diameter d of the hollow needle 111 constant. In this experiment, a silicon rubber was used for the material of the elastic member 45.

Table 5 summarizes the result of the experiment.

TABLE 5

| Diameter d of hollow needle | Thickness t of elastic member | t/d | evaluation |
|---|---|---|---|
| 1.28 | 1.8 | 1.41 | X |
| | 2.0 | 1.56 | ○ |
| | 2.3 | 1.8 | ○ |
| | 3.0 | 2.34 | ○ |
| | 3.5 | 2.73 | ○ |
| | 4.0 | 3.13 | ○ |
| | 4.5 | 3.5 | ○ |
| | 5.0 | 3.91 | X |
| | 5.5 | 4.30 | X |

As will be understood from Table 5, it is preferable to set the ratio (d:t) between the diameter d of the hollow needle and the thickness t of the elastic member 45 to fall in the range of 1:1.5-1:3.5.

When the ratio (t/d) is less than 1.5, the elastic member 45 becomes too thin and easily undergoes damaging upon insertion of the hollow needle 111 into the elastic member 45. Further, it was confirmed that the hole formed after drawing out the hollow needle 111 is not completely closed. On the other hand, when the ratio exceeds 3.5, the resistance at the time of stabbing the hollow needle 111 into the elastic member 45 for penetration becomes too large.

Here, it should be noted that the ink discharge port 34 of the holding member 22 is located generally at the central part of the ink bag 2 in the height direction as shown in FIG. 4. With this, the flow of ink inside the bag main body 21 of the ink bag 2 becomes smooth when using the ink cartridge 1 in the upright state (the state of FIG. 2) as compared with the case of FIG. 1 in which the ink exit is provided with deviation to one end of the cartridge and, it becomes possible to use out the ink more or less, without leaving unused ink.

Furthermore, engagement parts 51 and 52 are provided to the holding member 22 as a unitary body for engaging with a catch nail provided on a first case part 11 as will be described later. Further, the sidewall of the flange part 31 corresponding to the engagement parts 51 and 52 is formed with grooves 31*a* and 31*b* respectively in correspondence to the engagement parts 51 and 52.

Thus, the ink bag 2 has a construction in which the holding member 22 is fixed to an edge of the flexible bag main body 21 of generally quadrilateral form, and the holding member 22 is provided with an ink filling opening 33 used for filling the bag main body 21 with ink and an ink discharge port 34 for discharging the ink inside the bag main body. Further, as a result of provision of the engagement parts 51 and 52 for holding the ink bag 2 on the cartridge case 3 in which the ink bag 2 is accommodated, the remaining of the ink in the bag is minimized and the ink bag 2 can be attached easily to the case 3 acting as a protection cover removably and stably.

Figure 1:
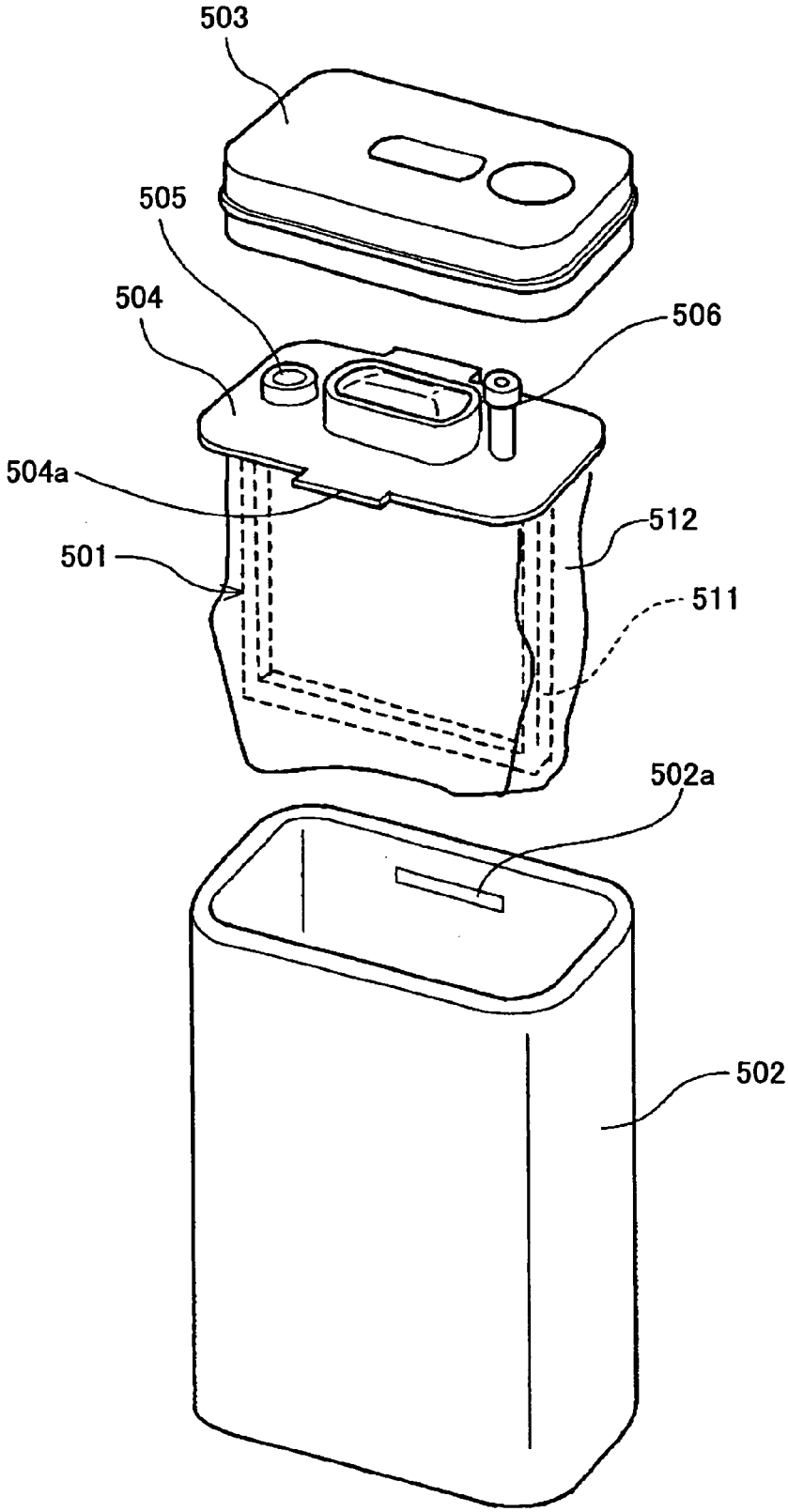
FIG. 1 is diagram showing an example of a conventional ink cartridge in an exploded oblique view.

Meanwhile, the ink discharge port 34 of the holding member 22 is located generally at the center of ink bag 2 in the height direction as shown in FIG. 4. Further, the ink discharge port 34 is formed such that the ink discharge port 34 is located generally at the center of the case 3 when the ink bag 2 is held in the ink cartridge 1 as shown in FIG. 2. With this, the flow of ink inside the bag main body 21 of the ink bag 2 becomes smooth when using the ink cartridge 1 in the upright state (the state of FIG. 2), as compared with the case in which the ink exit is provided with deviation to one end as shown in FIG. 1, and it becomes possible to use out the ink with certainty.

Further, as noted before, the engagement parts 51 and 52 are formed on the holding member 22 as a unitary body for engagement with catch nails provided to the first case part 11 as will be explained later. Further, the groove 31*a* and 31*b* are formed on the side surface of the flange part 31 in correspondence to the engagement parts 51 and 52. As a result, the contact area of the first case part 11 and the second case part 12 side is reduced, and a more stabilized holding is achieved at the side of the case 3.

In this way, the ink bag 2 is attached with the holding member 22, which constitutes the ink bag holding member of the present invention, such that the holding member 22 is fixed to an edge of the generally quadrilateral flexible bag main body 21, the holding member 22 including the ink filling opening 33 for filling the bag main body 21 with ink and the ink discharge port 34 for discharging the ink inside the bag main body. Further, the holding member 22 includes the engaging parts 51, 52 for holding the ink bag 2 in the cartridge case 3, and it becomes possible to mount the ink bag 2 detachably to the case 3 serving for the protection cover easily and with stability while minimizing the ink remaining in the bag unused.

Because the distal end part of the ink discharge port 34 of the holding member 22 is equipped with the elastic member 45 that sealing the opening and the cap member 46 that holds down the elastic member 45, reliable seal is formed by the restoration force of the elastic member 45 and leakage of the ink is eliminated even when the ink cartridge 1 is mounted and dismounted to and from the recording apparatus main body repeatedly and the supply needle (used for the ink introducing means for introducing the ink into the recording apparatus) of the recording apparatus is stabbed into the ink discharge port 34 repeatedly, and it becomes possible to supply the ink stably to the recording apparatus.

SECOND EMBODIMENT

Figure 19:
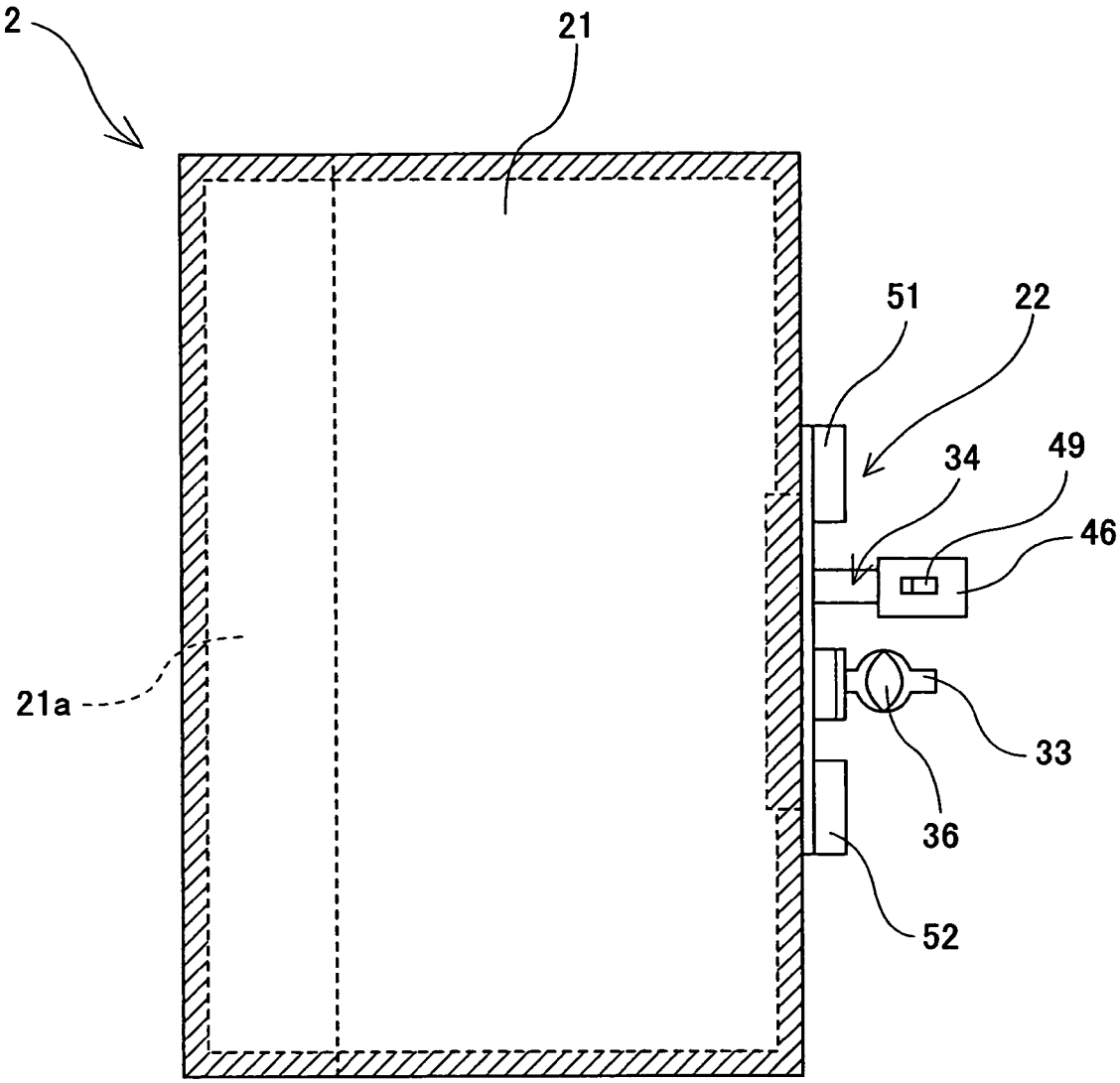
FIG. 19 is a side view showing another example of the ink bag of the present invention.
Figure 20:
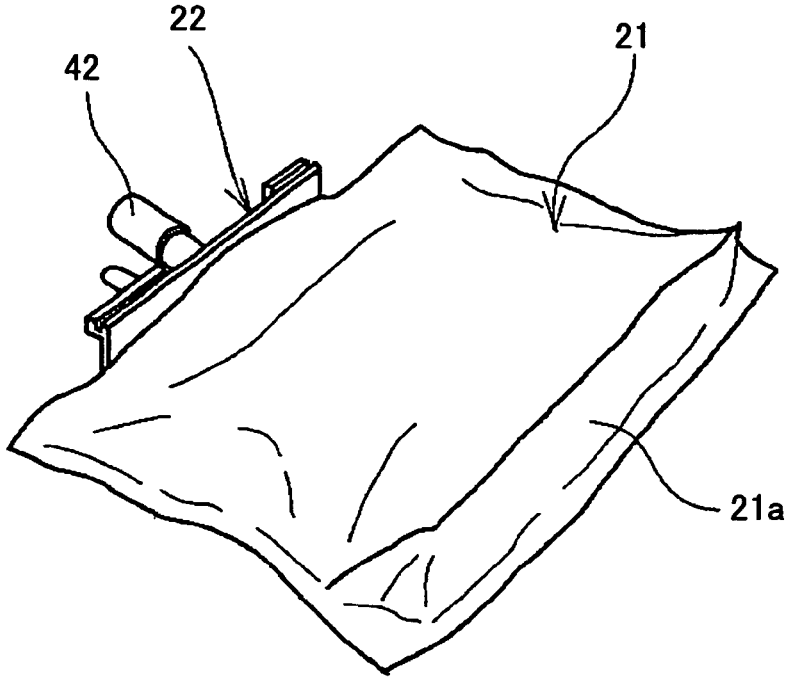
FIG. 20 is an oblique view showing the same ink bag in the state filled with ink.
Figure 21:
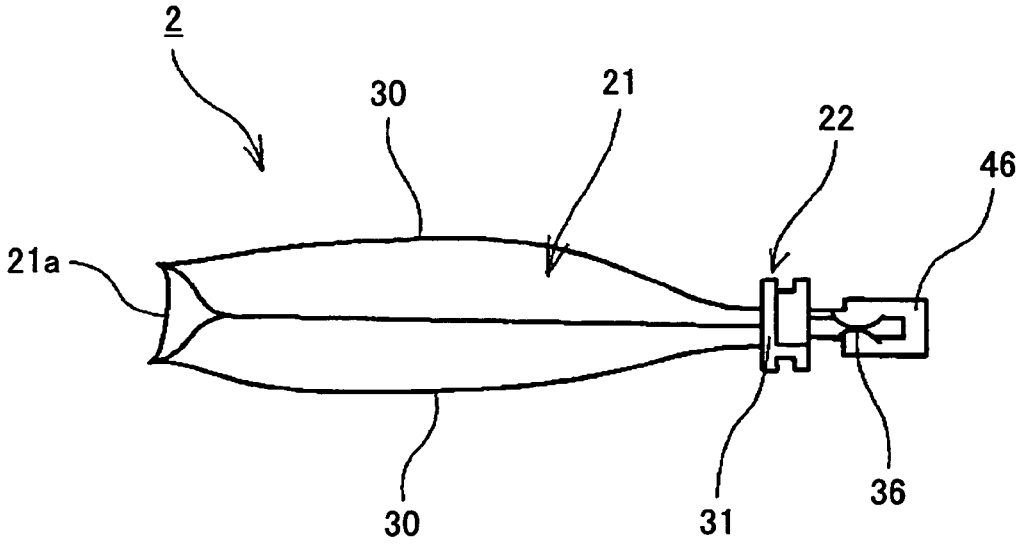
FIG. 21 is a diagram showing the ink bag of FIG. 20 as viewed from a downward direction in the state filled with ink.

Next, another example of the ink bag of the present invention will be explained with reference to FIGS. 19 through 21, wherein FIG. 19 is a side view diagram of the ink bag, FIG. 20 is an oblique view diagram showing the same ink bag in the state filled with ink, while FIG. 21 is a bottom view diagram of the ink bag of FIG. 20.

It should be noted that this ink bag 2 includes the bag body 21 of two aluminum laminate films 30 and 30, wherein there is further provided a rear part (bottom part) 21*a* at the rear side also formed of the aluminum laminate film. By using such three sheets of aluminum laminate films 30, the capacity of ink bag 2 can be increased.

Figure 22:
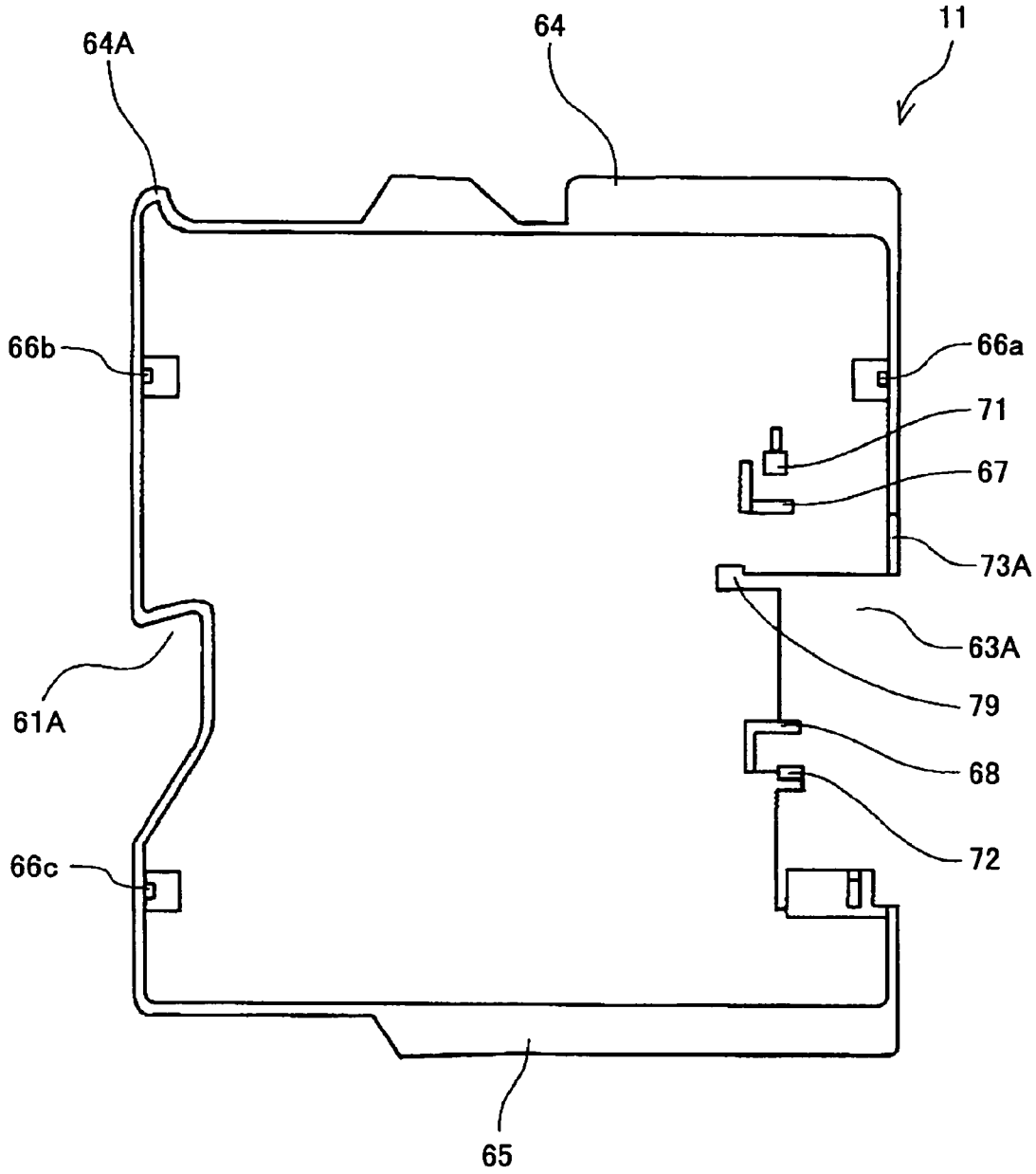
FIG. 22 is a side view showing a first case part of the ink cartridge of FIG. 2.
Figure 23:
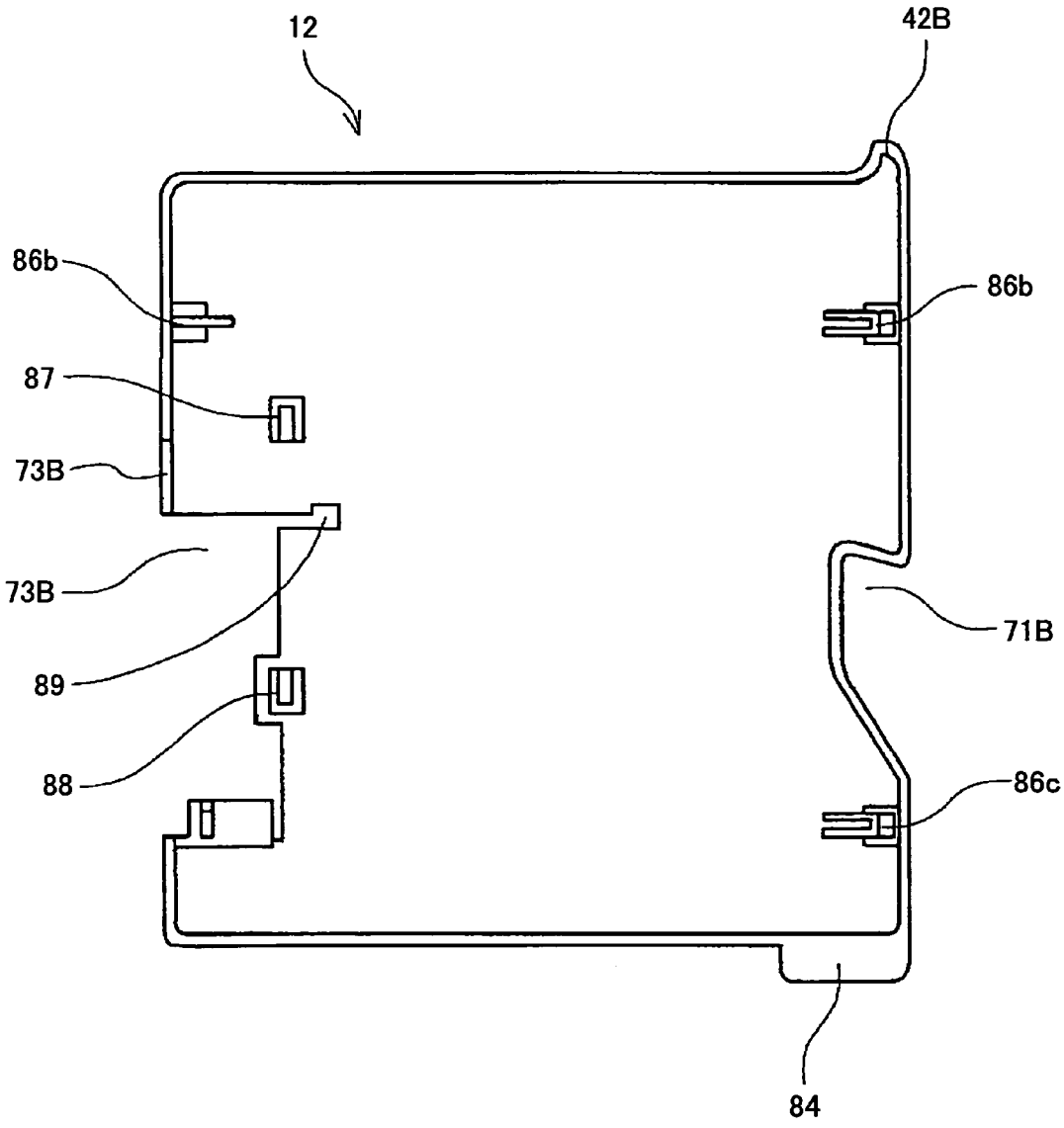
FIG. 23 is a side view showing a second case part of the ink cartridge of FIG. 2.

Next, the construction of the case of the ink cartridge 1 of the present embodiment will be explained withi reference to FIGS. 22 and 23, wherein it should be noted that FIG. 22 is a side view diagram of the first case part 11 of the ink cartridge 1, while FIG. 23 is a side view diagram of the second case part 12 of the ink cartridge 1.

It should be noted that the case 3 of the ink cartridge 1 is formed by assembling the first case part 11 and the second case part 12 of generally the same form divided out from a single, generally rectangular body, wherein the third case part 13 is attached to the front lower part thereof. As will be described later, there are formed, in the assembled state of the cartridge 1, a depressed part 61 and a hooking part 62 in the rear side thereof for facilitating gripping at the time of mounting and dismounting of the ink cartridge 1 to and from the recording apparatus body. Further, there is formed an opening 73 on the front side thereof in alignment with the ink discharge port 34 to the main body of the ink-jet recording apparatus.

As shown in FIG. 22, the first case part 11 has a generally rectangular external form and includes, on its circumferential part, a depressed part 61A and a hooking part 62A respectively in the form of dividing the depressed part 61 and the hooking part 62 into halves, a cutout part 63A for forming a space allowing entrance of the ink filling device for conducting filling of the ink by the ink filling device in the state in which the ink bag 2 is held by the first case part 11 and the second case part 12, and the guide parts 64 and 65 used for loading to the recording apparatus main body or for loading to the ink filling device, in the form of a unitary body.

Also, on the three corners of the inner wall surface of the first case part 11, there are formed engaging parts 66*a*, 66*b* and 66*c* for engagement with the catching nails of the second case part 12 as will be described later. Furthermore, on the inner wall surface of the first case part 11, there are formed positioning parts 67 and 68 for positioning the holding member 22 in order to hold the holding member 22 of ink bag 2. Further, there are formed the catching nails 71 and 72 for holding engaging projections 51 and 52 of the holding member 22. It should be noted that these positioning parts 67 and 68 and the catching nails 71 and 72 constitute the holding means or engage holding means (means for holding by causing engagement) that holds the holding member 22 of the ink bag 2.

Furthermore, there is formed a ¼ arc part 73A that forms a part of the opening 73 in the front side of the first case part 11 (the front side at the time of loading to the apparatus main body).

Also, the first case part 11 is formed with a depression 79 for engagement with a catching nail of the third case part 13 at the time of attaching the third case part 13.

Further, it should be noted that the second case part 12 has an external appearance generally similar to that of the first case part 11 as shown in FIG. 23 and includes, on its circumferential part, a depressed part 61B and a hooking part 62B respectively in the form of dividing the depressed part 61 and the hooking part 62 into halves, a cutout part 63B for forming a space allowing entrance of the ink filling device for conducting filling of the ink by the ink filling device in the state in which the ink bag 2 is held by the first case part 11 and the second case part 12, and distinction means 84 of protrusions indicating the color of the ink filled in the ink bag 2 of the ink cartridge 1.

Also, on the three corners of the inner wall surface of the second case part 12, there are formed engaging parts 86*a*, 86*b* and 86*c* for engagement respectively with the engaging parts 66*a*, 66*b* and 66*c* of the first case part 12 as in the form of a unitary body. Furthermore, on the inner wall surface of the second case part 12, there are formed engaging parts 87 and 88 having grooves for engagement with the holding member 22 of the ink bag 2.

Furthermore, there is formed a ¼ arc part 73B that forms a part of the opening 73 in the front side of the first case part 12 (the front side at the time of loading to the apparatus main body).

Also, the second case part 12 is formed with a depression 89 for engagement with a catching nail of the third case part 13 at the time of attaching the third case part 13.

As shown in FIG. 3, the third case part 13 is inserted into the cutout parts 63A and 63B of the first case part 11 and the second case part 12 at the front side where the ink supply is made in the state in which the first case part 11 and the second case part 12 are assembled. This third case part 13 is provided with catching nails 91 and 92 for engagement respectively with the engagement depressions 79 and 89 of the first case part 11 and the second case part 12 and further includes a ½ arc part 73 C that forms a part of the aforementioned opening 73.

Figure 24:
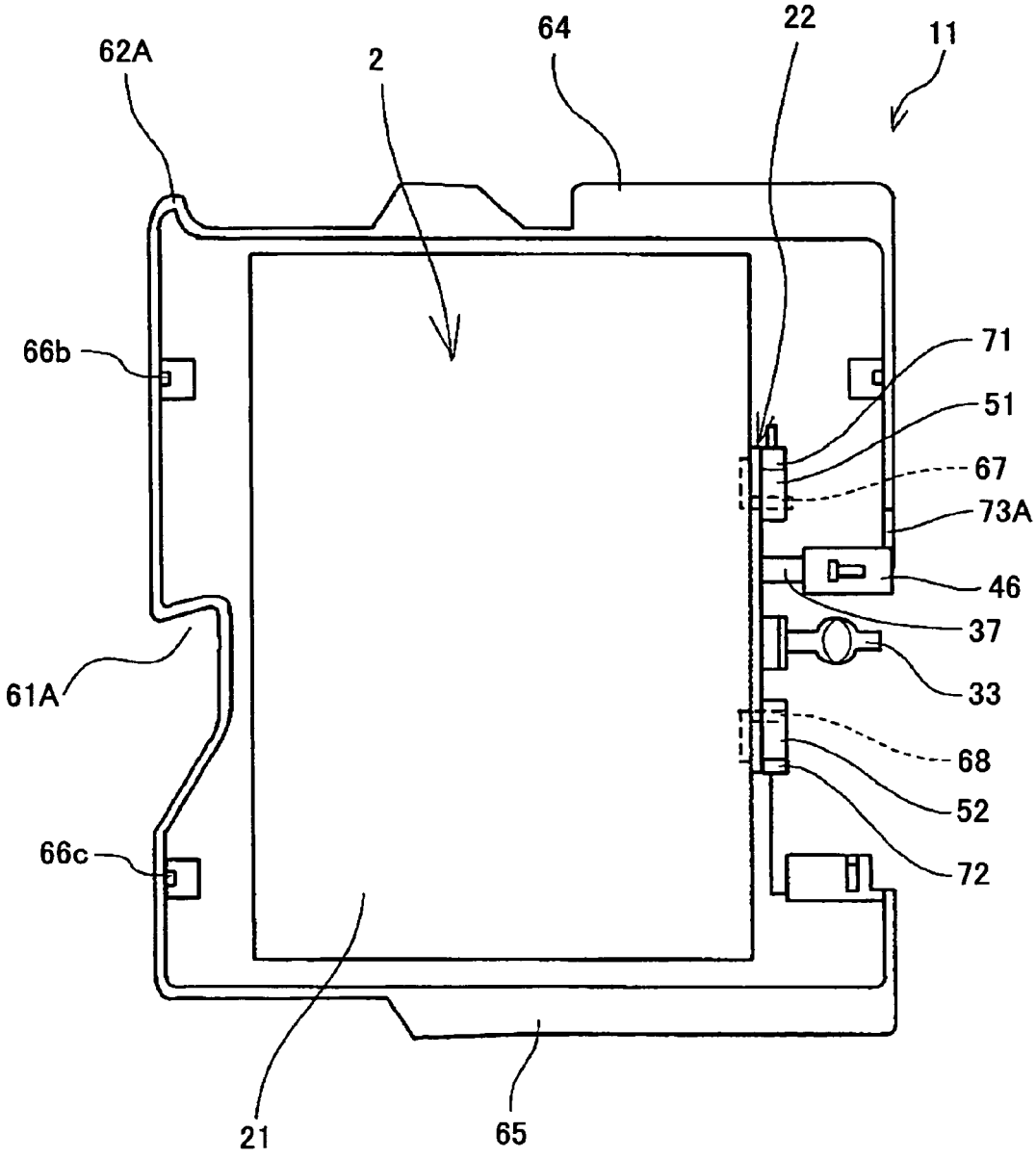
FIG. 24 is a side view showing the first case part of the ink cartridge of FIG. 2 in the state in which the ink bag is held to the first case part.

As a result of such a construction, the ink cartridge 1 is manufactured (assembled) as shown in FIG. 24 by urging the holding member 22 of the ink bag 2 while positioning by using the positioning parts 67 and 68 of the first case part 11. Thereby, it should be noted that the catching nails 71 and 72 of the first case part 11 engage with the projections 51 and 52 of the holding member 22 of the ink bag 2 respectively, and thus, the holding member 22 is held on the first case part 11.

Thereafter, the second case part 12 is placed on the first case part 11 and the first case part 11 and the second case part 12 are pressed with each other. With this, the catching nails 86*a*-86*c* of the second case part 12 cause engagement with the engaging parts 66*a*-66*c* of the first case part 11, and the assembling body (see FIG. 3) of the first case part 11 and the second case part 12 is obtained.

Further, as shown in FIG. 3, the third case part 13 is fitted upon the first case part 11 and the second case part 12 such that the catching nails 91 and 92 of the third case part 13 cause engagement with the corresponding depressions 79 and 89 of the first case part 11 and the second case part 12. Thereby the ink cartridge 1 as shown in FIG. 2 is completed.

Further, at the time of recycling the ink cartridge 1 by take out the ink bag 2 out of the ink cartridge 1 and replacing with a new ink bag 2, the third case part 13 is removed and the 2nd case part 12 and the first case part 11 are disassembled with a reverse procedure. Here, it should be noted that the third case part 13 and the first case part 11 and the second case part 12 are easily disassembled, because they in the lightly engaged state by the catching nails and the corresponding depressions.

Here, it should be noted that there is a possibility of damaging caused in the catching nail when the third case part 13 is used repeatedly. On the other hand, the user can inspect the state of the catching nail by merely removing the third case part 13. Thus, by discarding the case part 13 when the catching nails thereof have been damaged, it becomes possible to minimize the work process of the user.

Thus, by using a new ink bag 2 filled with the ink or by using the used ink bag 2 after filling with the ink, and by following the procedure explained before with reference to the ink cartridge 1, a recycled ink cartridge 1 is completed.

Here, the procedure of filling the ink in the ink bag 2 will be explained.

In this procedure, a hollow filling needle is inserted into the ink filling opening 33 in the state the holding member 22 of the ink bag 2 is held in the first case part 11. By supplying the ink from outside in this state, the ink is filled up in the bag main body 21.

Here, it should be noted that ink injection can be performed in the state in which the ink bag 2 is held by the first case part 11, and thus, it becomes possible to supply the ink while confirming the condition of the ink bag 2. Further, because the ink bag 2 is held by the first case part 11 during the procedure of filling of the ink, the ink bag 2 is held in the stabilized state at the time of filling the ink.

When filling of the ink to the bag main body 21 of the ink bag 2 has been completed, a thermal pressure head is urged to the ink filling opening 33 from both sides such that the ink filling opening 33 is sealed as a result of the welding process caused by the thermal pressure head.

Next, explanation will be made with regard to the method of filling the ink to a used ink bag 2.

First, a hollow filling needle is plugged in to the ink discharge port 34, and the ink is supplied from outside. With this, the ink is filled in the bag main body 21. Here, this procedure may be applied to the ink bag 2 itself in a stand alone state, or in the state in which the ink bag 2 is held by the first case part 11 as mentioned before. With this, refilling of the ink to ink bag 2 is achieved easily.

Further, it is also possible to rupture a part of the bag main body 21 of the ink bag 2 or puncture a hole in a part thereof and fill the ink to the bag main body 21 from such a hole. In this case, the rupture part or punctured part is sealed with a seal member after the refilling process. Further, in the case the ink filling opening 33 has a sufficient length, it is possible to cut the sealing part 36 and conduct the refilling of the ink through the ink filling opening 33 similarly to the initial filling process. Thereafter, the ink filling opening 33 is sealed a thermal welding process.

After such refilling of ink to a used ink bag 2, the ink cartridge case 3 is assembled similarly as noted before, and it becomes possible to obtain an ink cartridge 1 accommodating the ink bag 2.

Thus, the ink cartridge 1 of the present invention is constructed in a manner capable of being disassembled and reassembled by using the first case part holding the holding member of the ink bag, the second case part having an external form similar to that of the first case part and the third case part engaging with the first and second case parts in the assembled state thereof. Thereby, replacement of the ink bag can be conducted easily. Further, because of the construction in which the holding member of the ink bag is held with the first and second case parts forming the divided halves, and because the first and second case parts are split along the plane parallel to the ink supplying direction, the attitude of the ink bag is stabilized even in the case the front loading construction is employed, and stable ink supply becomes possible.

Furthermore, it should be noted that the relationship between the catching nails and the engaging parts may be reversed as compared with the embodiment mentioned above.

More specifically, it is possible to provide the catching nail to the first case part and the engaging part to the second case part for the mutual engagement of the first and second case parts, or alternatively the catching nails to the first and second case parts and the engaging part (engagement depression) to the third case part for the engagement between the first, second and third case parts. Further, while explanation has been made heretofore for the case in which the ink cartridge 1 is loaded from the front side of the ink-jet recording apparatus in the upright state, the present invention is applicable also to the case in which the ink cartridge 1 is loaded from the front side in the horizontal state.

THIRD EMBODIMENT

Next, other embodiment of the ink cartridge 1 will be explained with reference to FIGS. 25-30.

Figure 25:
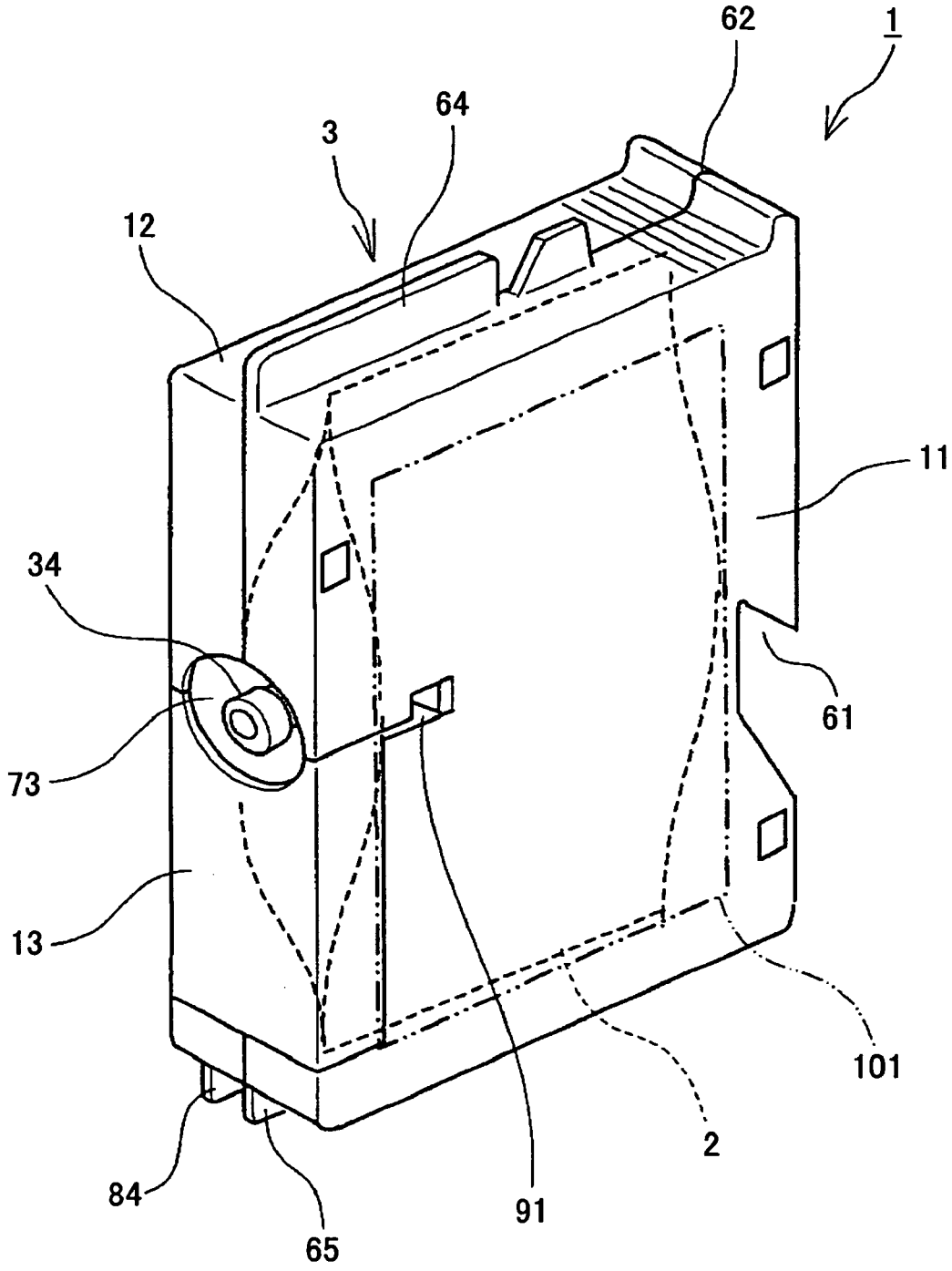
FIG. 25 is an oblique view diagram showing another example of the ink cartridge of the present invention.

The embodiment of FIG. 25 reinforces the engagement between the catching nail 91 and the first case part 11 and the second case part 12 of the third case part 13 by sticking a label 101 on the outside of the first case part 11 and the second case part 12. With this, it becomes possible to prevent dropping of the third case part 13 even in the case the ink cartridge 1 is inserted and removed frequently.

Figure 26:
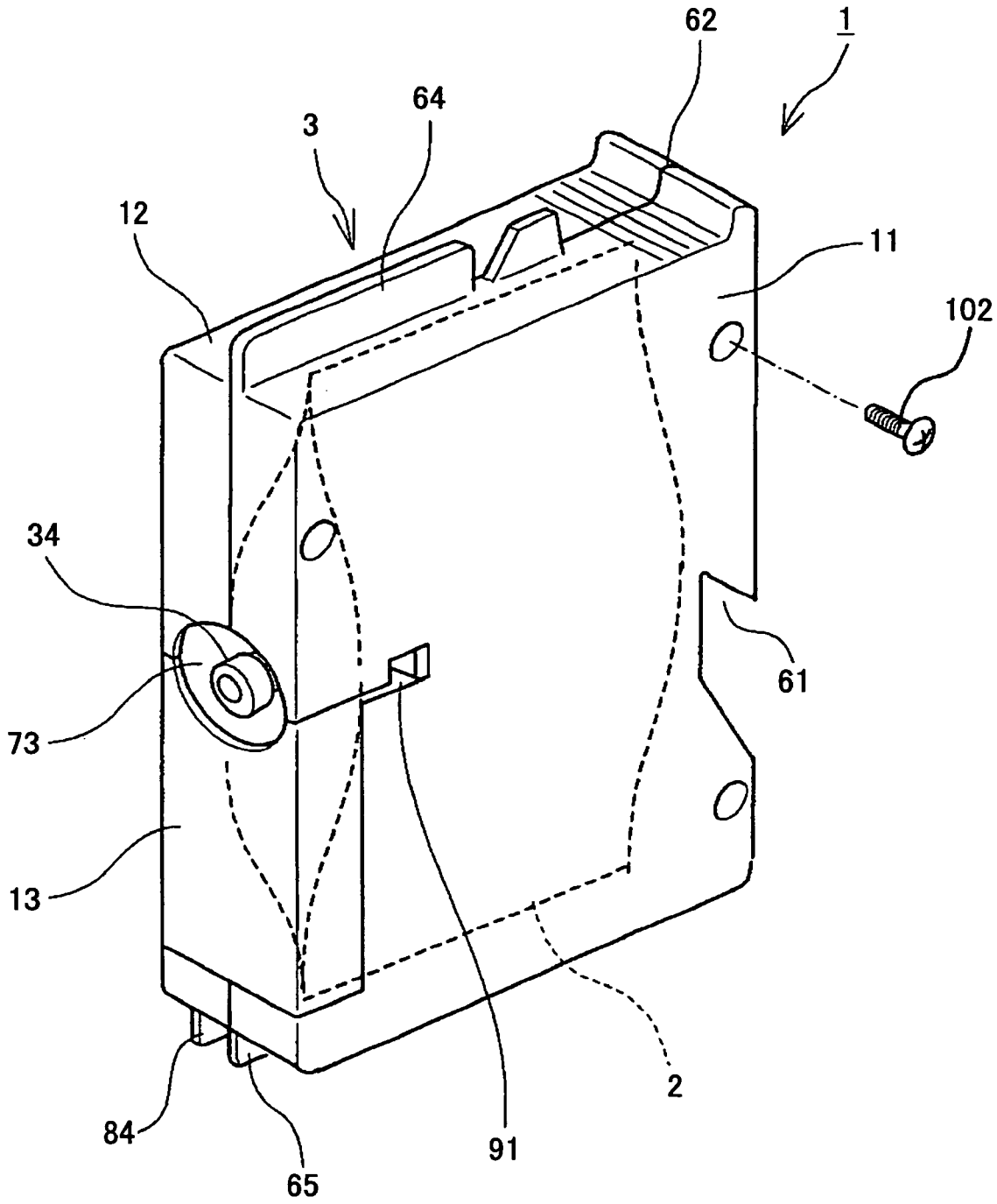
FIG. 26 is an oblique view diagram showing a further example of the ink cartridge of the present invention.

It should be noted that the embodiment of FIG. 26 fixes the first case part 11 and the second case part 12 by tightening a screw member 102. With this, disassembling of the case 3 is prevented even in the case in which the ink cartridge 1 is inserted and removed frequently.

Figure 27:
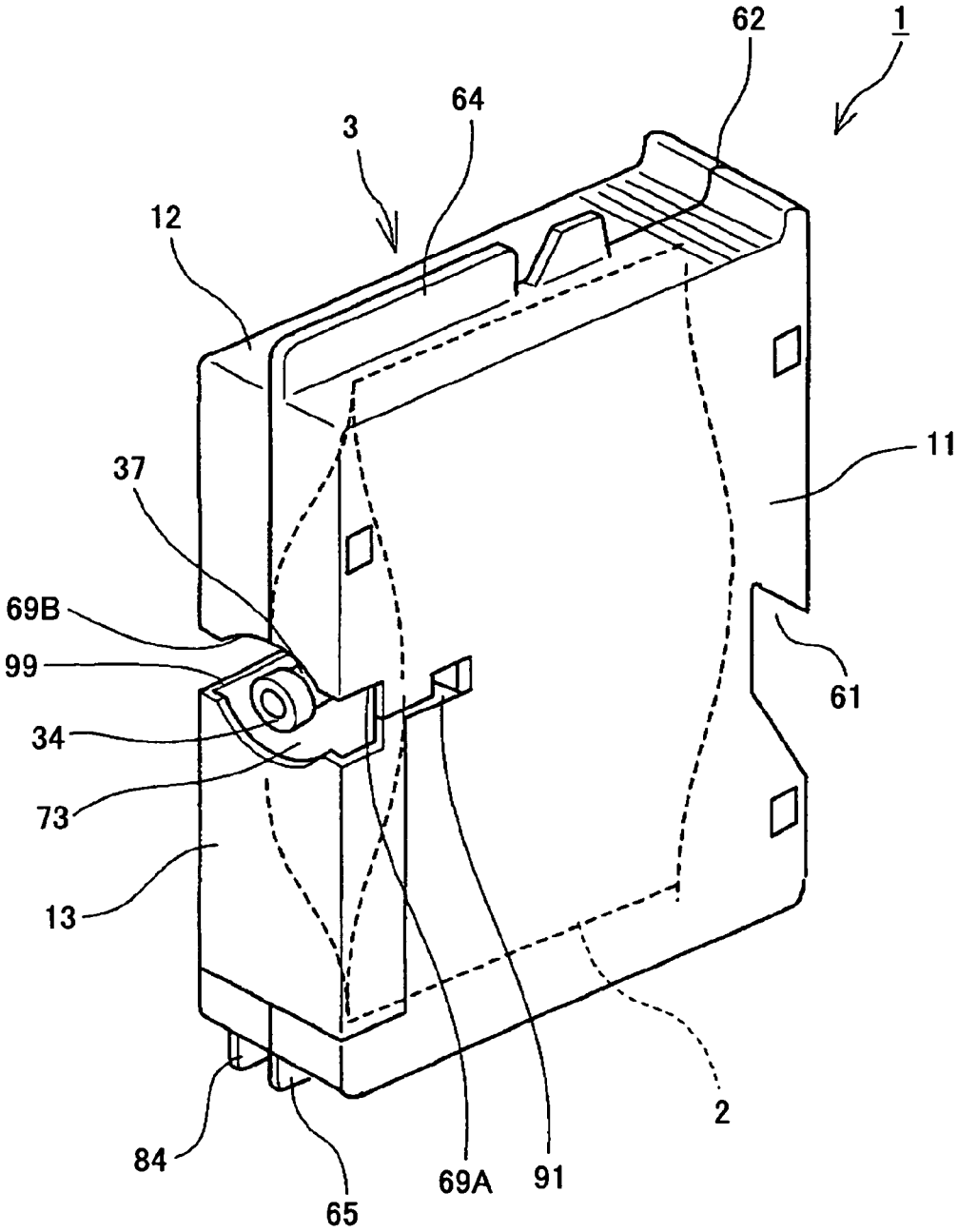
FIG. 27 is an oblique view diagram showing a further example of the ink cartridge of the present invention.

In the embodiment of FIG. 27, there are formed cutout parts 69A and 69B respectively on the first case part 11 and the second case part 12 so as to be located at the lateral side of the discharge port 34 of the ink bag 2 and/or the cap member 42 provided at the distal end part of the ink discharge port 34. Further, the third case part 13 is also formed with a cutout part 99 at the lateral side of the ink discharge port 34 of the ink bag 2 and/or the cap member 42 provided at the distal end part of the ink discharge port 34.

With this, it becomes possible to prevent a needle guard, which is provided at the time of inserting the needle into ink discharge port 34 from the recording apparatus side around the needle when the ink cartridge case is thin, making a contact with the first case part 11, the second case part 12 or the third case part 13.

Figure 28:
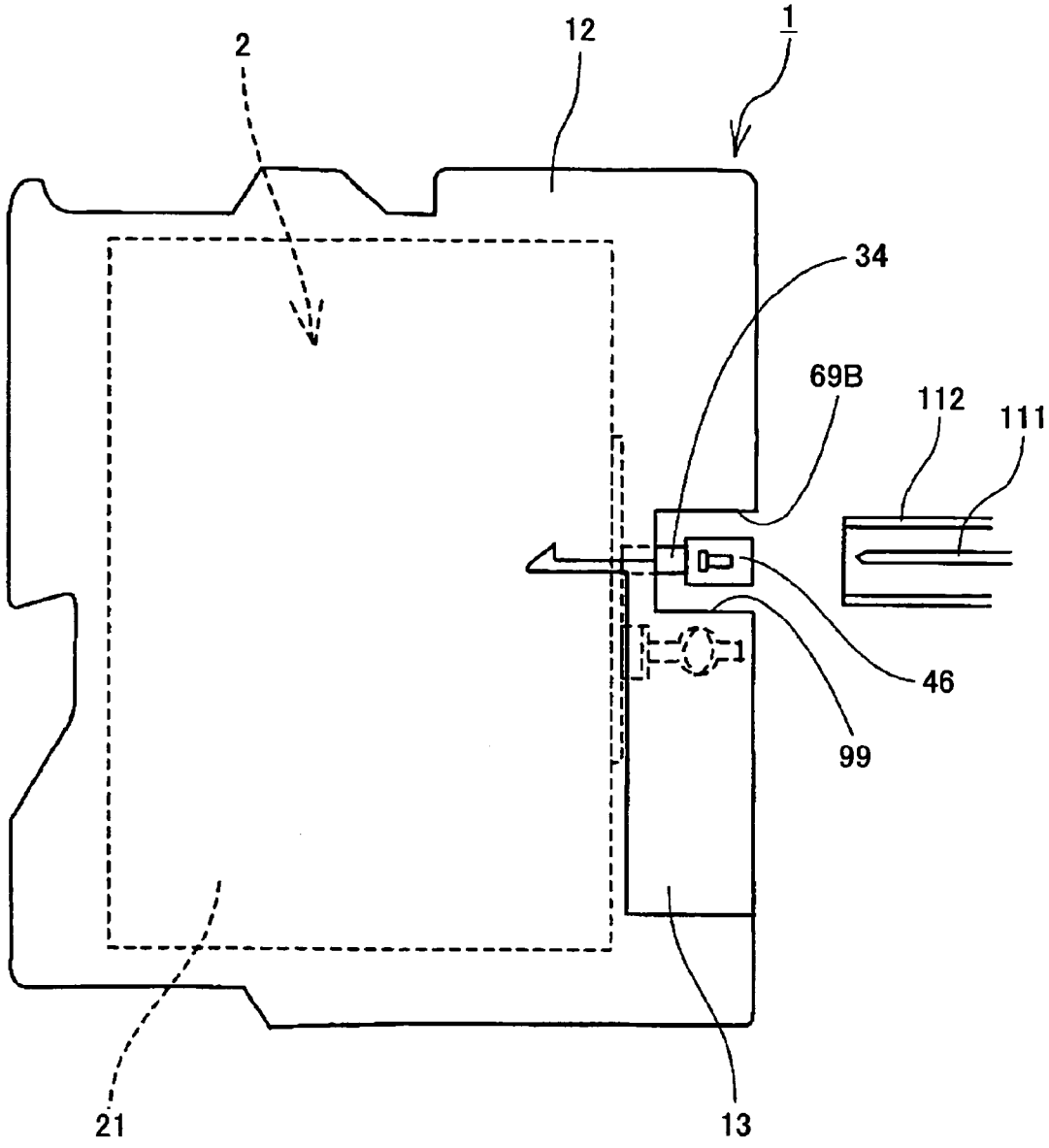
FIG. 28 is a side view diagram for explaining the connection between this the ink cartridge and the main body of a recording apparatus.

More specifically, the needle 111 is stabbed into the in ink discharge port 34 of the ink cartridge 1 from the side of the recording apparatus body as shown in FIG. 28 for achieving connection between the ink bag 2 and the ink supply system of the ink-jet recording apparatus, wherein there is provided a needle guard 112 in the side of the recording apparatus so as to surround the needle 111 for protection of the needle 111.

Figure 29:
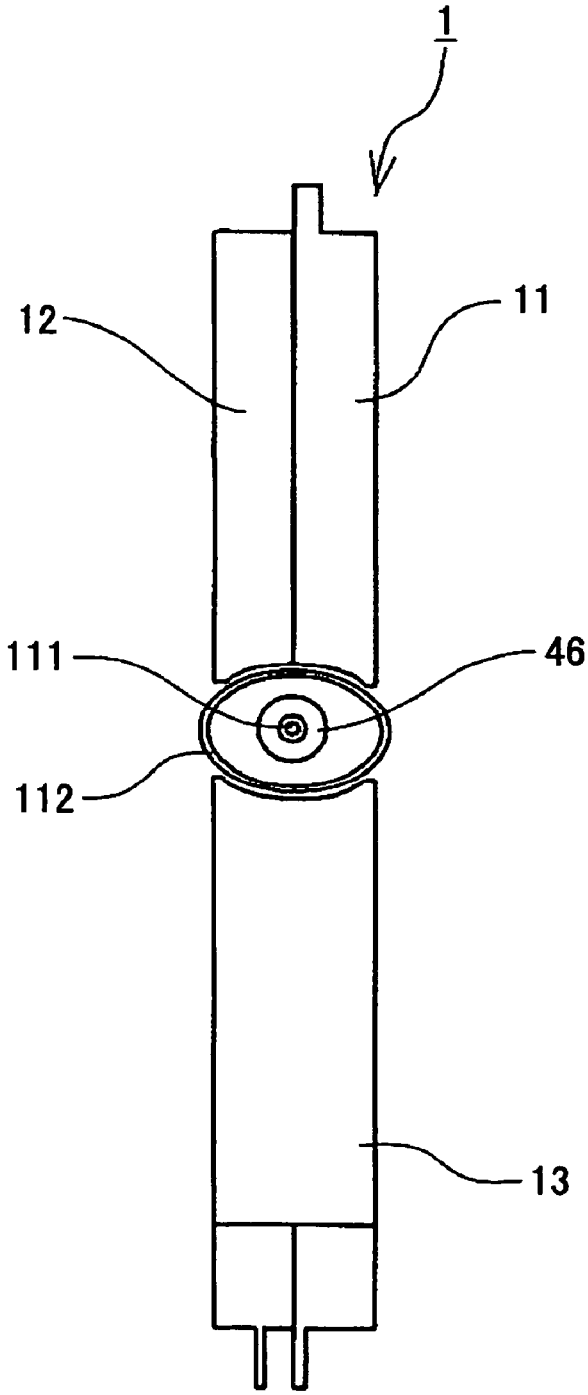
FIG. 29 is a front view diagram of FIG. 27.

Now, when the thickness of the ink cartridge 1 has been reduced, it becomes not possible to secure the opening for accepting the needle guard 112 by the opening 73 alone. On the other hand, by providing the cutout part to the lateral side of the ink discharge port 34 and/or the cap member 42 in the case parts 11, 12 and 13 in continuation with the opening 73 at the side parts thereof, it becomes possible for the needle guard 112 to invade into the opening 73 without contacting the case as shown in FIG. 29. Thus, it becomes possible with the present embodiment to reduce the thickness of the ink cartridge further.

Figure 30:
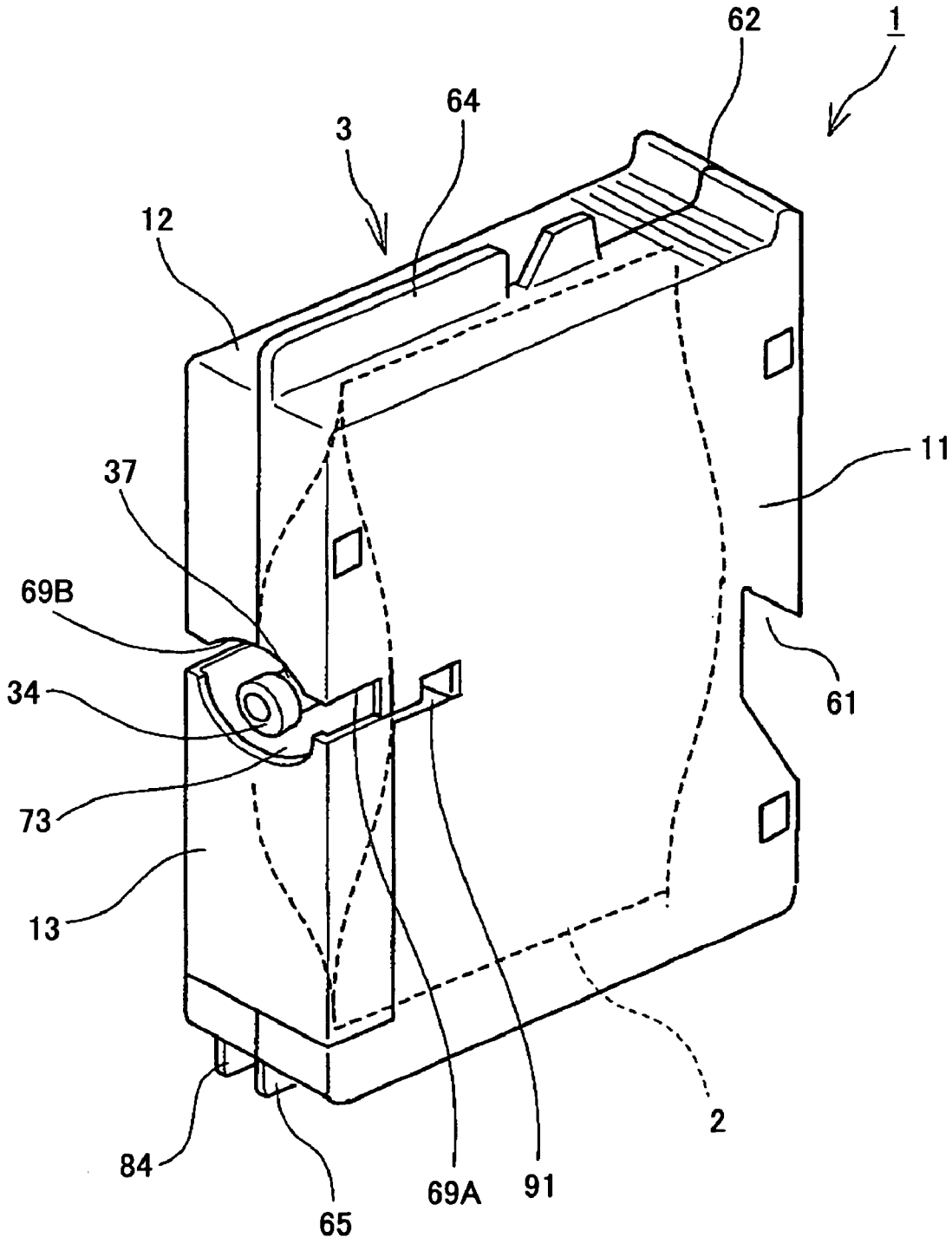
FIG. 30 is an oblique view showing a further example of the ink cartridge of the present invention.

In the embodiment shown in FIG. 30, it can be seen that there are formed cutout parts 69A and 69B respectively in the first case part 11 and the second case part 12 at the lateral sides of the cap member 46 provided to the distal end part of the ink discharge port 34 of the ink bag 2 acting as the ink storage means and/or the ink discharge port 34. Depending on the position of the cutout parts 69A and 69B, it is possible not to form the cutout part in the third case part 13.

Figure 31:
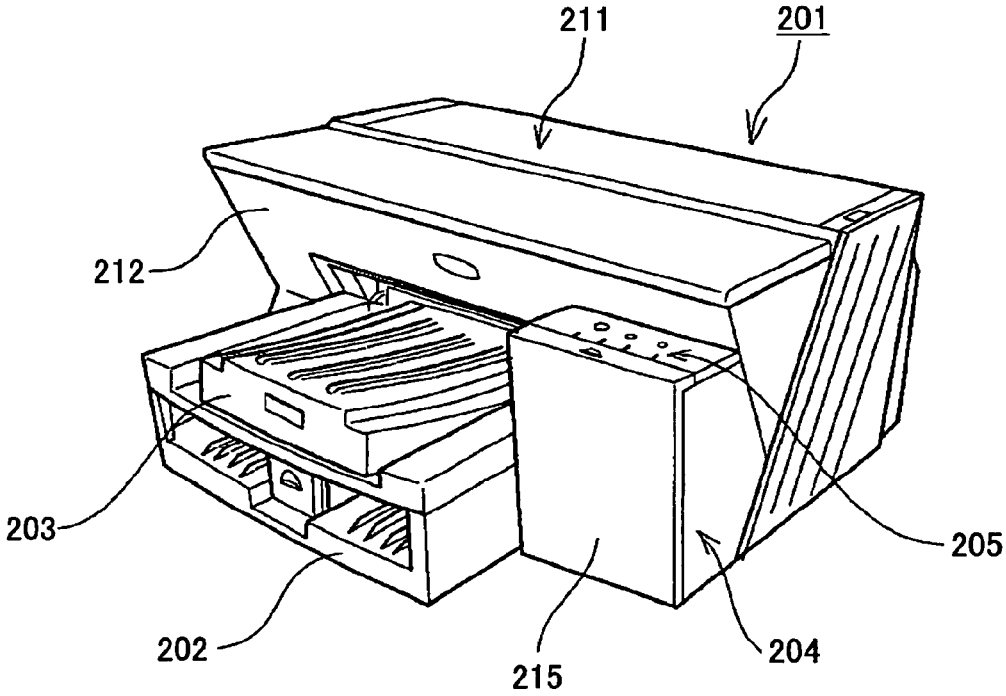
FIG. 31 is an oblique view diagram showing the ink-jet recording apparatus of the present invention as viewed from a front direction.
Figure 32:
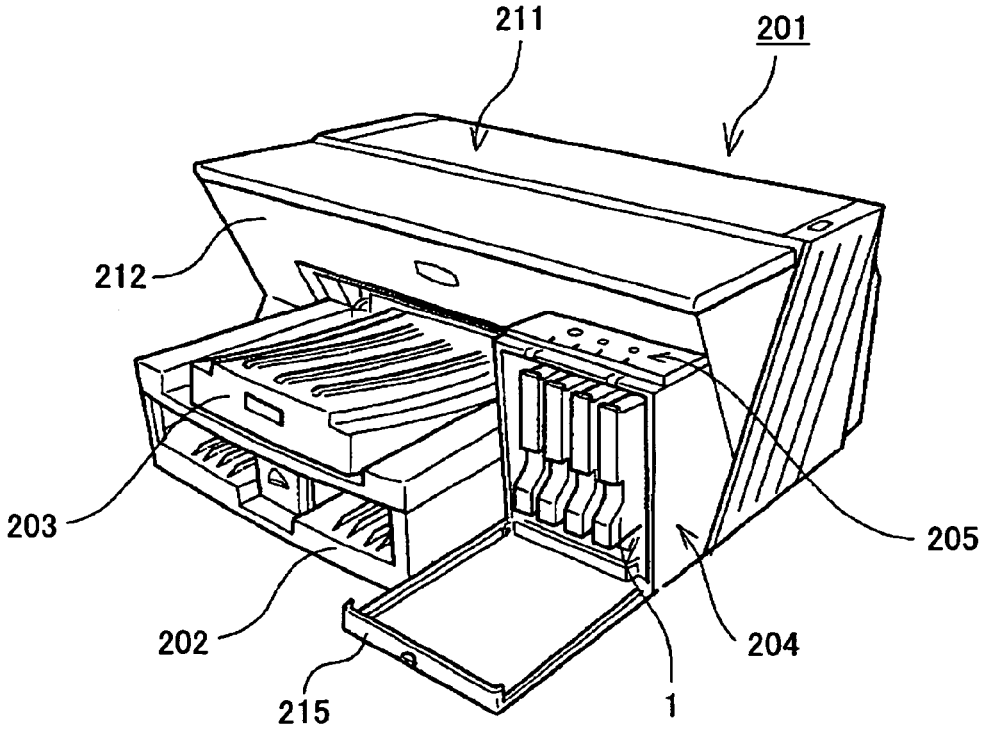
FIG. 32 is an oblique view diagram showing the ink-jet recording apparatus of the present invention in the state in which a cover of the ink cartridge loading part thereof is opened.

Next, an example of the ink-jet recording apparatus that uses the ink cartridge that mentioned above will be explained with reference to FIGS. 31-34, wherein FIG. 31 is a diagram showing the ink-jet recording apparatus of the present invention in a perspective view from a front direction thereof, FIG. 32 is a diagram showing an ink cartridge loading part of the ink-jet recording apparatus of FIG. 31 in the state in which the cover is opened, FIG. 33 is a schematic diagram showing the overall construction of the mechanism part of the ink-jet recording apparatus, while FIG. 34 is the a diagram showing the mechanism part in detail.

Referring to the drawings, this ink-jet recording apparatus includes an apparatus main body 201, a sheet feed tray 202 for loading a sheet set to the apparatus main body 201, and a sheet ejection tray 203 attached to the apparatus main body 201 for accumulating the sheet recorded with images. The top cover 211 of the apparatus main body 201 forms a generally flat surface, and the front cover of the apparatus main body 201 has a front surface 212 inclined obliquely in the rear bottom direction with respect to the foregoing top surface.

Further, at the lower part of this inclined front surface 212, there are provided a sheet discharging tray 203 and also a sheet feeding tray 202 so as to project in the forward (the front side) direction.

Further, there is provided an ink cartridge loading part 204 at an end part of the front surface 212 so as to project from the foregoing front surface 212 in the forward direction under the top cover 211, and an operation part 205 including various operation keys and indicators is provided on the top surface of this ink cartridge loading part 204. This ink cartridge loading part 204 is further provided with a front cover 215 opened and closed for loading and unloading the ink cartridge 1.

Figure 33:
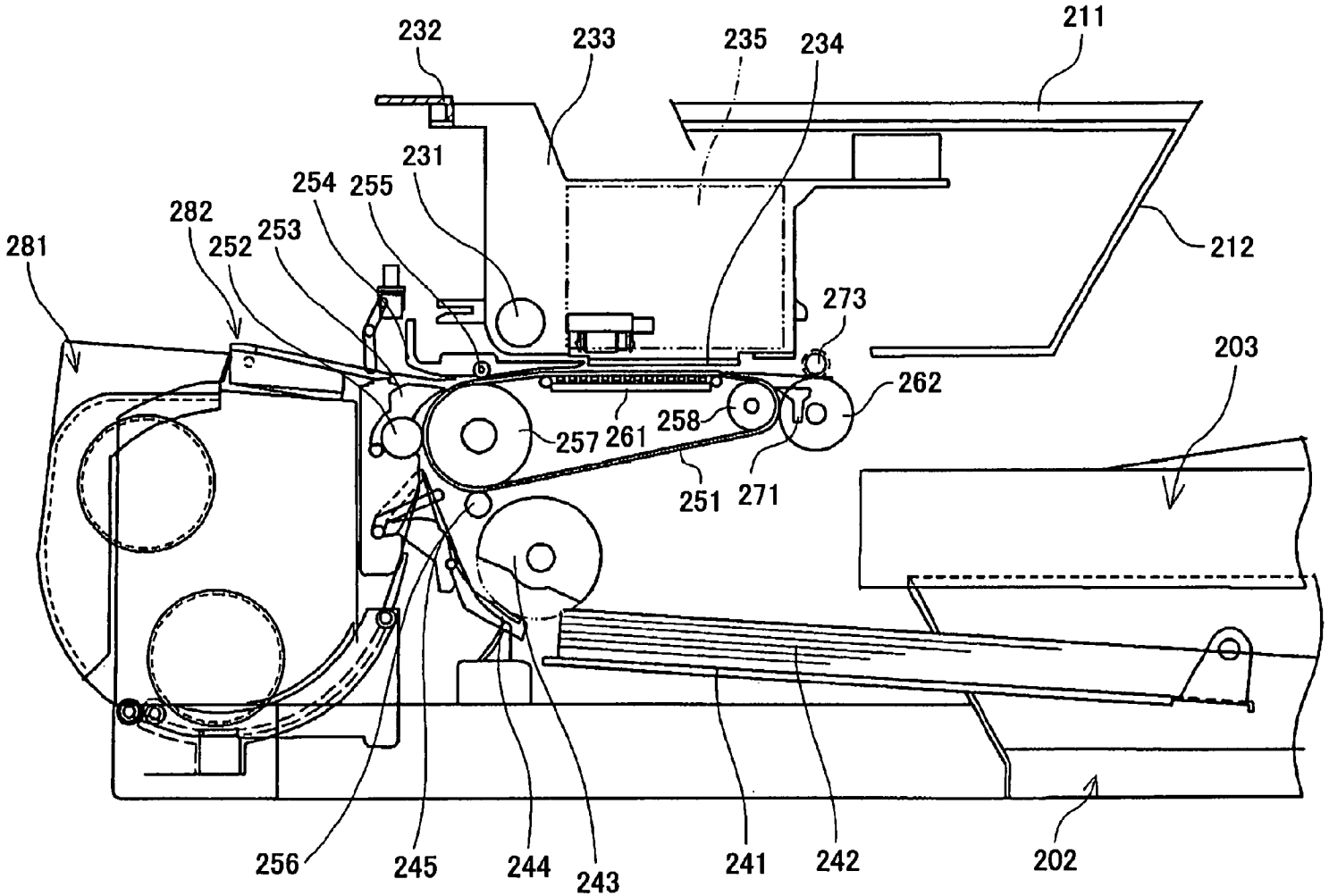
FIG. 33 is a diagram showing an overall construction of the mechanism part of the ink-jet recording apparatus.
Figure 34:
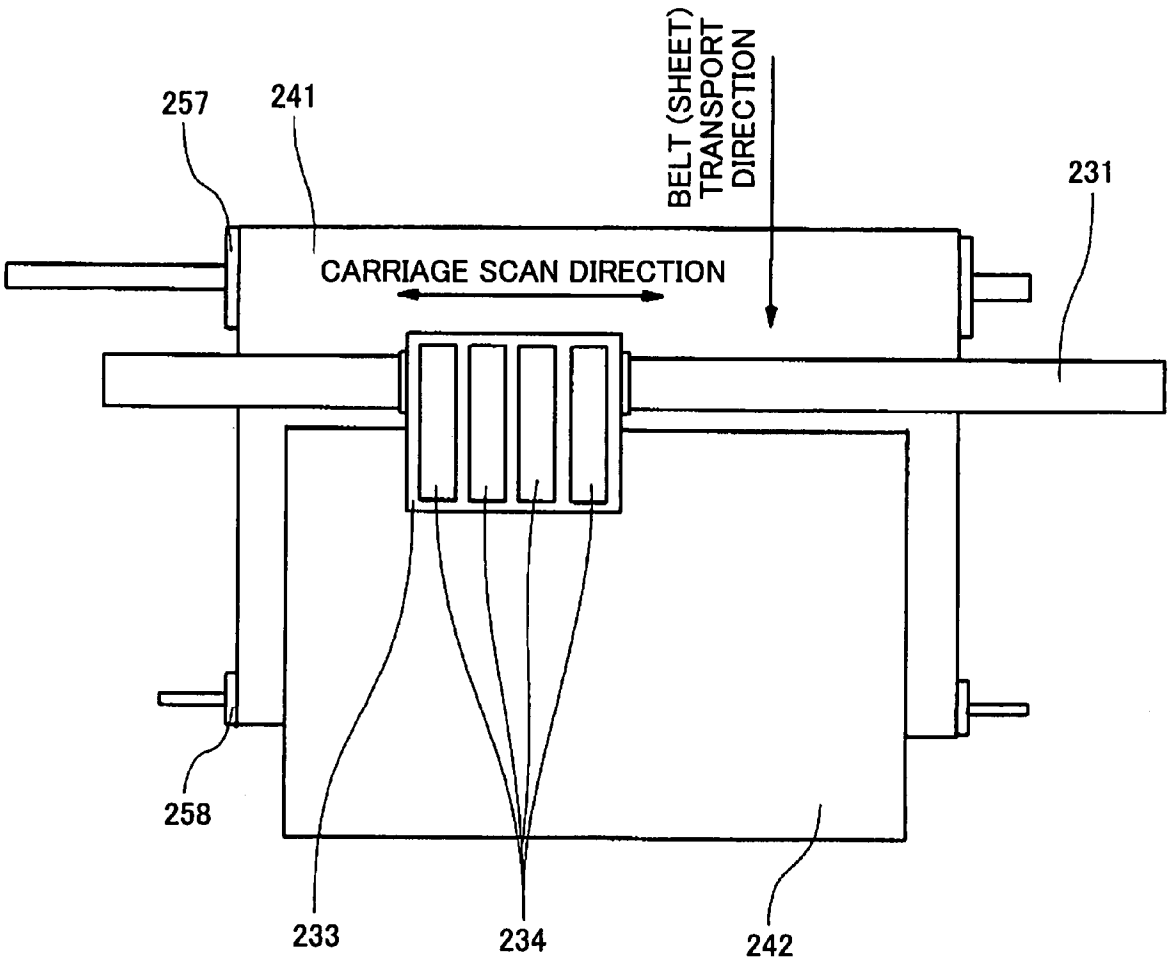
FIG. 34 is a diagram showing the mechanism part in a plan view.

In the apparatus main body 201, a carriage 233 is held movably in a main scanning direction by a guide rod 231 held laterally by a pair of side boards provided at the and left and right but not illustrated and a stay 232 as shown in FIGS. 33 and 34, wherein the carriage is moved in the direction indicated by arrows in FIG. 34 by a main scanning motor not illustrated.

On this carriage 233, there is provided a recording head 234 formed of four ink-jet heads respectively ejecting ink droplets of yellow (Y), cyan (C), magenta (M) and black (Bk) in such a manner that the ink ejection nozzles are aligned in the direction crossing the main scanning direction. Thereby, the ink droplets are ejected in the downward direction.

For the ink-jet head that constitutes the recording head 234, it is possible to use a piezoelectric actuator such as piezoelectric element, a thermal actuator that uses phase change such as boiling of liquid film caused by an electricity-to-heat conversion element such a resistance heater, a shape memory alloy actuator that uses metal phase change caused by temperature change, an electrostatic actuator using static electricity, and the like, for the energy source of ink ejection.

Further, the carriage 233 carries sub tanks 235 of the respective colors for supplying the inks to the recording head 234. Thereby, the ink is supplied to the sub tank 235 from the ink discharge port 34 of the ink bag 2 of the ink cartridge 1, which is loaded to the ink cartridge loading part 205, via an ink supply tube not illustrated.

Further, there is provided a sheet feed part for feeding the sheets 242 loaded on the sheet storage part (pressure board) 241 of the sheet feeding tray 203 one by one, wherein the sheet feed part includes a half-circle roller (sheet feed roller) 243 supplying the sheet 242 one at a time from the sheet loading part 241 and a separation pad 244 opposing the sheet feed roller 243 and formed of a material of large friction coefficient, and this separation pad 244 is urged toward the sheet feed roller 243.

Further, there is provided a sheet transportation part for transporting the sheet 242 supplied from the foregoing sheet feed part underneath the recording head 234, wherein the sheet transpiration part includes a transportation belt 251 transporting the sheet 242 with electrostatic absorption, a counter roller 252 that transports the sheet 242 fed from the sheet feed part through the guide 245 by sandwiching the same together with the transportation belt 251, a transportation guide 253 for changing the direction of the sheet 242 supplied vertically in the upward direction by about 90 degrees for causing the sheet to imitate with the transportation belt 251, and a end pressure roller 255 urged to the conveyance belt 251 with a pressing member 254. Further, there is provided a charging roller 256 for electrostatic charging of the surface of the transportation belt 251.

Here, it should be noted that the transportation belt 251 is an endless belt laid between a transportation roller 257 and a tension roller 258 and circles in the belt transportation direction. It should be noted that this transportation belt 251 may include a surface layer part acting as a sheet adhering surface and formed of a resin material such as the one having a thickness of 40 μm and not processed with resistance control such as an ETFE pure material and a back layer part of the same material as the surface layer part and processed with resistance control carbon (middle resistance layer or ground layer).

Further, a guide member 261 is disposed in the reverse side of the transportation belt 251 in correspondence to the recording region in which recording is made on the sheet by the recording head 234.

Further, there is formed a sheet discharging part for discharging the sheet 242 recorded with images by the recording head 234 by a separation nail 271 for separating the sheet 242 from the transportation belt 251, a sheet discharging roller 272 and a sheet discharging roller 273. Further, there is provided a sheet discharging tray 203 underneath the sheet discharging roller 272.

Also, there is provided a sheet feed unit 281 for both side recording on the rear side of the apparatus main body 201 in a detachable manner, wherein the sheet feed unit 281 for both side recording takes up the sheet 242 returned as a result of counter rotation of the transportation belt 251 and turns the sheet over. Thereafter, the sheet is fed between the counter roller 252 and the transportation belt 251 again. Also, there is provided a hand sheet feed part 282 above the sheet feed unit 281 for both side recording.

Thus, in the ink-jet recording apparatus having the construction noted above, the sheet 242 is separated one by one from the sheet feed part, wherein the sheet 242 fed in the generally upward direction is guided with the guide 245 and is transported by being sandwiched between the transportation belt 251 and the counter roller 252. The sheet is further guided with the transportation guide 253 at the top part thereof and is urged to the transportation belt 251 with the pressure roller 255 at the tip end part. Thereby, the transportation direction is changed by about 90 degrees.

Here, it should be noted that the transportation belt 257 is charged with electricity by the charging roller 256, and the sheet 242 is transported by the transportation belt 251 in the state adhered thereto by the static electricity.

Thus, by driving the recording head 234 with image signal while moving carriage 233, one line of recording is made on the sheet 242 as a result of discharging of the ink droplets in the state that the recording sheet 242 is held stationary. Further, after transporting the sheet 242 with a predetermined amount, recording for the next line is conducted.

When a signal indicating that the edge of the sheet 242 has been reached or the recording is completed, the recording operation is terminated and the sheet 242 is discharged to the discharging tray 203.

Now, when near end of the ink inside the sub tank 235 is detected, a necessary amount of ink is supplied to the sub tank 235 from the ink cartridge 1.

Because the ink-jet recording apparatus is equipped with the ink cartridge 1 of the present invention, it becomes possible to exchange the ink bag 2 inside the ink cartridge 1 when the ink therein is used up by replacing only the ink bag 2 inside the cartridge 1 by disassembling the case 3. Further, such a construction allows stable ink supply even in the case the ink cartridge 1 is loaded from the front side in the upright state, and thus, it is possible to exchange the ink cartridge 1 easily even in the case in which the upper part of the apparatus main body 201 is occupied as in the case of the ink-jet recording apparatus being accommodated in a rack or the top surface of the ink jet apparatus main body 201 is used to support some other object.

While the present invention has been explained with regard to the example of the ink-jet recording apparatus of shuttle type in which the carriage scans the recording sheet, the present invention is applicable also to the ink-jet recording apparatus of line type equipped with a line type head. Also, the ink-jet recording apparatus of the present invention is applicable to other various apparatuses such as a facsimile device, a copying apparatus, printer/fax/copier complex machine, and the like, in addition to the ink-jet printer.

INDUSTRIAL APPLICABILITY

As explained heretofore, the ink bag of the present invention includes a flexible bag main body of generally quadrilateral form and a holding member fixed to an edge of the flexible bag main body, wherein the holding member is provided with an ink filling opening for fills ink to the bag main body, an ink discharge port for discharging the ink in the bag main body and further with an engaging part for holding the ink bag to the cartridge case in which the ink bag is accommodated. As a result of such a construction, remaining of the unused ink in the ink bag is minimized and it becomes possible to detachably attach the ink bag to the case stably with ease.

The ink cartridge of the present invention includes at least first and second case parts of similar external form in such a manner that the first and second case parts can be assembled with each other and decomposed into individual pieces and holds the holding member of the ink bag of the present invention at the engagement holding means provided to the first case part as a result of causing engagement. As a result, the cartridge is easily assembled and decomposed and the remaining of unused ink is minimized. Further, the ink bag can be attached and detached easily to and from the case of the ink cartridge.

The ink-jet recording apparatus of the present invention has a construction in which loading of the ink cartridge of the present invention is possible from the front side of the apparatus. Thus, it becomes possible to replace only the ink bag when the ink in the ink cartridge is used up. Further, it becomes possible to supply the ink stably.

According to the ink filling method of the present invention, the ink is filled from the ink filling opening in the state in which the holding member of the ink bag is held to the first case part and thus, it becomes possible to fill the ink easily in a stabilized state.

According to the ink refilling method of the present invention, the ink is filled from the ink discharge port in the state in which the holding member of the ink bag is held to the first case part. Thereby, it becomes possible to refill the ink easily in a stabilized state.

According to the ink refilling method of the present invention, a rupture part or puncturing is provided to a part of the bag main body of the ink bag and the rupture part is sealed after ink is filled into the bag main body from this rupture part or puncturing, and because of this, it becomes possible to refill the ink easily.

According to the manufacturing method of the ink cartridge of the present invention, the holding member of the ink bag filled with the ink is held to the first case part and then the second case part is attached to the first case part. Thus, the ink cartridge can be assembled easily.

According to the recycling method of the ink cartridge of the present invention, the first and second case parts are disassembled from each other and the ink bag is removed by dismounting the holding member of the ink bag from the first case part. Further, the holding member of the ink bag filled with the ink is held to the engagement holding part of the first case part and the first and second case parts are assembled with each other. Thus, the ink cartridge case is not wasted and recycled effectively.

As explained heretofore, the ink bag holding member of the present invention is such a member used for accommodating the ink bag main body having flexibility into the ink cartridge and includes an ink filling opening for fills ink into the bag main body, an ink discharge port for discharging the ink inside the bag main body, and further an engaging part held by the engaging means provided to at least one of the case parts forming a half body of the cartridge case. Thus, it is possible to hold a flexible ink bag stably in the ink cartridge.

According to the ink cartridge of the present invention, the ink bag that having the ink bag holding member of the present invention is accommodated therein, and thus, it becomes possible to stably accommodate the ink bag having flexibility therein.

According to the ink-jet recording apparatus of the present invention, the ink cartridge of the present invention can be loaded from the front direction, and thus, it becomes possible to replace only the ink bag when the ink the ink cartridge is used up.

According to the ink cartridge of the present invention, there is provided a case formed of case half bodies, at least one of the case half bodies having the means for holding the holding member formed with the ink discharge port and an elastic member is provided at a distal end part of the ink discharge port formed in the holding member for sealing the opening. Further, there is provided a cap member for holding down the elastic member. As a result, it becomes possible to supply the ink stably without causing leakage of the ink. Further, easy reuse of the cartridge case or ink storage means becomes possible.

According to the ink-jet recording apparatus of the present invention, the ink cartridge of the present invention can be loaded from the front side thereof, and thus, it becomes possible to replace only the ink storage means when the ink in the ink cartridge is used up. Further, stable ink supply is realized.

According to the ink bag of the present invention, a holding member is fixed to a bag main body having flexibility, wherein the holding member is provided with an ink filling opening for filling ink into the ink bag main body and an ink discharge port for discharging the ink inside the bag main body. Further, the holding member is provided with an engaging part for holding the ink bag to the cartridge case formed of case half bodies. As a result, remaining of unused ink is minimized and the ink bag can be attached detachably to the case easily and stably. Thereby, stable ink supply is realized.

According to the ink cartridge of the present invention, the ink cartridge includes a case formed of at least first and second case parts having similar external form wherein these first and second case parts can be assembled and disassembled to and form each other. Further, the holding member of the ink bag of the present invention is held at the engagement holding means provided to the first case part. Thus, assembling and disassembling is made easily and remaining of unused ink is minimized. Further, it becomes possible to attach the ink bag to the case removably, stably and easily.

According to the image formation apparatus of the present invention in which the ink cartridge of the present invention is loaded, it becomes possible to replace only the ink bag when the ink in the ink cartridge is used up. Further, it becomes possible to realize stable ink supply.

The present invention is not limited to the specifically disclosed embodiments, and variations and modifications may be made without departing from the scope of the invention.

The present invention is based on Japanese Priority Patent Applications 2003-074520 filed on Mar. 18, 2003, 2003-076676 filed on Mar. 20, 2003, 2003-076663 filed on Mar. 20, 2003 and 2003-183326 filed on Jun. 26, 2003, the entire contents thereof is incorporated herein by reference.

The invention claimed is:

1. An ink bag holding ink therein, comprising:

a flexible bag body of a generally rectangular form; and a holding member attached to one edge of said bag body, said holding member comprising:

an ink filing opening for filling said bag body with ink;

an ink discharging port for discharging the ink inside said bag body; and an engaging part for holding said ink bag to a cartridge case in which said ink bag is accommodated, wherein said ink filling opening and said ink discharge port of said holding member are located generally at a center of an edge of said bag main body.

2. The ink bag as claimed in claim 1, wherein a width-to-height ratio (W/H) of said bag main body falls in the range of $1 \leqq W/H \leqq 1.5$.

3. The ink bag as claimed in claim 1, wherein said holding member of said ink bag is held in such a state that said ink discharge port is located generally at the center of said cartridge case in a height direction thereof when said ink bag is accommodated in said cartridge case.

4. The ink bag as claimed in claim 1, wherein said ink filling opening is sealed by welding in the state in which said bag main body is filled with ink.

5. The ink bug as claimed in claim 1, wherein said holding member is provided to a longer edge of said ink bag main body.

6. The ink bag as claimed in claim 1, further comprising, at said ink discharging port, an elastic member sealing an opening at a distal end part of said ink discharging port and a cap member holding down said elastic member.

7. The ink bag as claimed in claim 6, wherein said holding member includes a stepped part on a circumferential surface of said ink discharge port for engagement with an engaging piece provided on said cap member.

8. The ink bag as claimed in claim 6, wherein said elastic member is a columnar member of a rubber material of any of silicone, fluorine and a butyl.

9. The ink bag as claimed in claim 6, wherein said cap member is a cylindrical member having a flange part that holds down said elastic member, and wherein said cylindrical member has plural engaging pieces bent inward.

10. An ink cartridge accommodating therein an ink bag, said ink bag comprising:

an ink filling opening for filling ink to said bag main body;

an ink discharge port for discharging said ink inside said bag main body; and an engaging part far engagement with a corresponding engagement part provided to at least one of case half bodies, said case half bodies constituting together a cartridge case of said ink cartridge, wherein said ink filling opening and said ink discharge port of said holding member are located generally at a center of an edge of said bag main body.

11. An ink-jet recording apparatus loaded with an ink cartridge from a front side thereof, said ink cartridge accommodating therein an ink bag, said ink bag comprising:

an ink filling opening for Filling ink to said bag main body;

an ink discharge port for discharging said ink inside said bag main body; and an engaging part for engagement with a corresponding engagement part provided to at least one of case half bodies, said case half bodies constituting together a cartridge case of said ink cartridge, wherein said ink filling opening and said ink discharge port of said holding member are located generally at a center of an edge of said bag main body.

12. An ink cartridge for supplying ink to outside through an ink discharge port, comprising:

case half bodies forming together a single cartridge case of said ink cartridge, at least one of said case half bodies having a holding part for holding a holding member formed with an ink filling opening and said ink discharge port:

an elastic member provided at a distal end part of said ink discharge port of said holding member for sealing an opening; and a cap member for holding down said elastic member, wherein said ink filling opening and said ink discharge port of said holding member are located generally at a center of an edge of the case half body.

13. The ink cartridge as claimed in claim 12, wherein said holding member includes a stepped part to a circumference surface of said ink discharge port so as to engage with an engaging piece provided it to said cap member.

14. The ink cartridge as claimed in claim 12, wherein said elastic member is formed of a rubber material selected from any of a silicone rubber material, a fluorine rubber material end a butyl rubber material.

15. The ink cartridge as claimed in claim 12, wherein said cap member comprises a cylindrical member having a flange part for holding down said elastic member, and wherein said cylindrical member having plural engaging piece bent inward.

16. An ink-jet recording apparatus loaded with an ink cartridge from a front side thereof, said ink cartridge supplying ink to said ink-jet recording apparatus through an ink discharge port and comprising:

case half bodies forming together a single cartridge case of said ink cartridge, at least one of said case half bodies having a holding part for holding a holding member formed with an ink filling opening and said ink discharge port;

an elastic member provided at a distal end part of said ink discharge port of said holding member for sealing an opening; and a cap member for holding down said elastic members, wherein said ink filling opening and said ink discharge port of said holding member are locate generally at a center of an edge of the case half body.

17. An ink bag for holding ink, comprising:

a flexible bag main body; and a holding member fixed to said bag main body, said holding member comprising an ink filling opening for filling ink to said bag main body, an ink discharge port for discharging said ink inside said bag main body, and an engaging part for holding said ink bag to a cartridge case formed of case half bodies, wherein said ink filling opening and said ink discharge port of said holding member are located generally at a center of an edge of said bag main body.

18. The ink bag as claimed in claim 17, wherein said ink discharge port includes a cylindrical part forming an outlet hole of said ink inside said bag main body, and wherein said cylindrical part is formed with a material that does not exert influence to properties of said ink.

19. The ink bag as claimed in claim 18, wherein said cylindrical part has a holding part holding an elastic member inserted to said outlet hole for sealing in the form of a unitary body.

20. The ink bag as claimed in claim 17, wherein said ink discharge port has an elastic member for sealing an outlet hole of said ink inside said bag main body, and wherein said elastic member is formed with a material that does not exert influence on properties of said ink.

21. The ink bag as claimed in claim 20, wherein said elastic member is formed of a rubber of silicone or silicone based rubber not exerting influence to properties of said ink.

22. The ink bag as claimed in claim 21, wherein there is formed a stepped part for engagement with an engaging piece provided to said cap member on a circumferential surface of said ink discharge port.

23. An ink bag as claimed in claim 21, wherein said cap member is formed of a cylindrical member having a flange part for holds down said elastic member, and wherein said cylindrical part has plural engaging pieces bent inward.

24. The ink bag as claimed in claim 20, wherein an, outer diameter D of said elastic member and an inner diameter D' of a part to which said elastic member is inserted forms a ratio D:D' so as to fall in the range of 1:0.85-1:0.92.

25. The ink bag as claimed in claim 20, wherein a thickness t of the said elastic member and a depth H of a part in which said elastic member is inserted forms a ratio t:H falling in the range of 1:0.77-1:1.

26. The ink bag as claimed in claim 20, wherein a hollow needle pierced into said elastic member for taking out said ink held inside said bag main body has a diameter d determined such that a ratio d:D of said diameter d to an outer diameter D of said elastic member falls in a range of 1:3-1:10.

27. The ink bag as claimed in claim 20, wherein a hollow needle pierced into said elastic member for taking our said ink held inside said bag main body has a diameter d determined such that a ratio d:t of said diameter d to a thickness t of said elastic member falls in a range of 1:1.5-1:3.5.

28. The ink bag as claimed in claim 17, wherein said ink discharge port is provided with a cap member so as to cover at least a part of an elastic member sealing an ink outlet hole of the ink inside said bag main body, said cap member being formed with a material not exerting influence on the properties of said ink.

29. The ink bag as claimed in claim 17, wherein said holding member of said ink bag is held in a state that said ink discharge port is located generally at a center in a height direction of said cartridge case when said ink bag is accommodated in said cartridge case.

30. The ink bag as claimed in claim 17, wherein said ink filling opening is sealed by welding in the state in which said ink bag is filled with said ink.

31. An ink cartridge accommodating an ink bag therein, comprising:

at least first and second cases parts of similar external appearance, said fist case part and said second case part forming a single cartridge case when assembled with each other, said single cartridge case being disassembled into said first and second case parts, said ink bag comprising:

a flexible bag main body; and a holding member fixed to said bag main body, said holding member comprising an ink filling opening for filling ink to said bag main body, an ink discharge port for discharging said ink inside said bag main body, and an engaging part for holding said ink bag to a cartridge case formed of case half bodies, said holding member of said ink bag being held to an engagement holding means provided to said first case part, wherein said ink filling opening and said ink discharge port of said holding member are located generally at a center of an edge of said bag main body.

32. An ink-jet recording apparatus loaded with an ink cartridge accommodating an ink bag holding ink therein, said ink cartridge comprising:

at least first and second cases parts of similar external appearance, said fist case part and said second case part forming a single cartridge case when assembled with each other, said single cartridge case being disassembled into said first and second case parts, said ink bag comprising:

a flexible bag main body; and a holding member fixed to said bag main body, said holding member comprising an ink filling opening for filling ink to said bag main body, an ink discharge port for discharging said ink inside said bag main body, and an engaging part for holding said ink bag to a cartridge case formed of case half bodies, said holding member of said ink bag being held to an engagement holding means provided to said first case part, wherein said ink filling opening and said ink discharge port of said holding member are located generally at a center of an edge of said bag main body.

33. An ink-jet recording apparatus as claimed in claim 32, wherein said ink cartridge is loaded from a front side of an apparatus body of said ink-jet recording apparatus.

* * * * *